US008268255B2

(12) United States Patent
Yoshimi et al.

(10) Patent No.: US 8,268,255 B2
(45) Date of Patent: Sep. 18, 2012

(54) HOLDING SEALING MATERIAL, METHOD FOR MANUFACTURING HOLDING SEALING MATERIAL, AND EXHAUST GAS PURIFYING APPARATUS

(75) Inventors: Mitsunori Yoshimi, Takahama (JP); Masayuki Eguchi, Takahama (JP); Yasuhiro Tsuchimoto, Ogaki (JP)

(73) Assignee: Ibiden Co., Ltd., Ogaki-Shi (JP)

( * ) Notice: Subject to any disclaimer, the term of this patent is extended or adjusted under 35 U.S.C. 154(b) by 561 days.

(21) Appl. No.: 12/424,737

(22) Filed: Apr. 16, 2009

(65) Prior Publication Data

US 2009/0269254 A1 Oct. 29, 2009

(30) Foreign Application Priority Data

Apr. 23, 2008 (JP) ..... 2008-112824

(51) Int. Cl.
*B01D 50/00* (2006.01)

(52) U.S. Cl. ..... 422/179

(58) Field of Classification Search ..... 422/177, 422/179, 180
See application file for complete search history.

(56) References Cited

U.S. PATENT DOCUMENTS

| | | | | | |
|---|---|---|---|---|---|
| 2,970,556 | A * | 2/1961 | Johnson | 112/315 |
| 3,874,958 | A * | 4/1975 | Scholtis et al. | 216/7 |
| 4,228,208 | A * | 10/1980 | Smith et al. | 428/95 |
| 4,430,851 | A * | 2/1984 | Sundet | 57/211 |
| 4,722,203 | A * | 2/1988 | Darjee | 66/202 |
| 5,032,441 | A | 7/1991 | Ten et al. | |
| 5,332,609 | A * | 7/1994 | Corn | 428/77 |
| 6,613,295 | B1 | 9/2003 | Kageyama et al. | |
| 6,737,146 | B2 * | 5/2004 | Schierz et al. | 428/74 |
| 7,587,819 | B1 * | 9/2009 | Hall, Jr. | 29/890 |
| 2004/0052698 | A1 * | 3/2004 | Sanocki et al. | 422/179 |
| 2006/0154040 | A1 * | 7/2006 | Merry | 428/292.1 |

FOREIGN PATENT DOCUMENTS

| | | | |
|---|---|---|---|
| EP | 1908934 | | 4/2008 |
| JP | 3-003915 | | 1/1991 |
| JP | 2000-161050 | | 6/2000 |
| JP | 2001-065337 | | 3/2001 |
| JP | 2005133340 | A * | 5/2005 |
| JP | 2007-218221 | | 8/2007 |
| KR | 2008-30465 | | 4/2008 |

* cited by examiner

*Primary Examiner* — Tom Duong
(74) *Attorney, Agent, or Firm* — Ditthavong Mori & Steiner, P.C.

(57) ABSTRACT

A holding sealing material includes a plurality of mats. The plurality of mats have a longitudinal direction and include a lower mat and an upper mat laminated on the lower mat. Each of the plurality of mats includes inorganic fibers and has a substantially rectangular shape. A length of the lower mat in the longitudinal direction is longer than a length of the upper mat in the longitudinal direction. Each of the plurality of mats is connected to each other at at least two fixed portions. The at least two fixed portions are positioned at different positions in the longitudinal direction.

38 Claims, 9 Drawing Sheets

A-A line cross-sectional view

B-B line cross-sectional view

HOLDING SEALING MATERIAL, METHOD FOR MANUFACTURING HOLDING SEALING MATERIAL, AND EXHAUST GAS PURIFYING APPARATUS

CROSS-REFERENCE TO RELATED APPLICATIONS

The present application claims priority under 35 U.S.C. §119 to Japanese Patent Application No. 2008-112824, filed Apr. 23, 2008, the contents of which are incorporated herein by reference in their entirety.

BACKGROUND OF THE INVENTION

1. Field of the Invention

The present invention relates to a holding sealing material, a method for manufacturing a holding sealing material, and an exhaust gas purifying apparatus.

2. Discussion of the Background

Particulate matters (hereinafter, also referred to as PMs) are contained in exhaust gases discharged from internal combustion engines such as diesel engines, and in recent years, there has arisen a serious problem that these PMs are harmful to the environment and the human bodies. Moreover, since exhaust gases also contain toxic gas components such as CO, HC, and NOx, there have been growing concerns about influences of these toxic gas components on the environment and the human bodies.

In view of these, as an exhaust gas purifying apparatus for collecting PMs in exhaust gases and for purifying the toxic gas components, various exhaust gas purifying apparatuses have been proposed. Each of the exhaust gas purifying apparatuses is configured by: an exhaust gas treating body made of porous ceramics, such as silicon carbide and cordierite; a casing configured to accommodate the exhaust gas treating body; and a holding sealing material made of an inorganic fiber aggregated body that is disposed between the exhaust gas treating body and the casing. This holding sealing material is installed mainly for purposes of preventing the exhaust gas treating body from being damaged upon contact with the casing that covers its periphery because of vibrations and impacts caused by traveling or the like of an automobile and for preventing exhaust gases from leaking between the exhaust gas treating body and the casing.

Here, since the internal combustion engines are operated at an air fuel ratio close to the theoretical air fuel ratio for the purpose of improvement in fuel consumption, exhaust gases tend to increase their temperature and pressure. When exhaust gases having a high temperature and a high pressure reach the exhaust gas purifying apparatus, the difference of coefficient of thermal expansion between the exhaust gas treating body and the casing leads to variations of the interval therebetween. Therefore, the holding force of the exhaust gas treating body that does not change with some variations of the interval is required of the holding sealing material. In order to allow the exhaust gas treating body to effectively exert exhaust gas treating properties, there has been a growing demand for a holding sealing material having heat insulating property to keep the exhaust gas treating body warm.

For the purpose of fulfilling these demands, there has been employed, in recent years, a designing method to increase the thickness of the holding sealing material and thereby improve heat insulating property. In such a holding sealing material, it is necessary to increase the unit weight of the holding sealing material for securing the repulsive force of inorganic fibers which is a factor of the holding force.

On the other hand, a holding sealing material has been proposed which exhibits a higher weight by combining a plurality of mats having the same weight as the weight of conventional mats instead of changing the thickness of each of the holding sealing materials. There is disclosed a holding sealing material, which is configured by laminating a plurality of heat-resistant mats, and which has a length set so that each of the mats can be wound around a monolith without any looseness and fitting portions thereof are fitted to each other when each of the mats is wound around the monolith in a laminated state (JP-A 2007-218221).

Here, in the holding sealing material of JP-A 2007-218221, in order to regulate the free movement in the width direction of each of the mats, which poses a problem when a plurality of mats are laminated, a binding portion is provided by sewing processing.

The contents of JP-A 2007-218221 are incorporated herein by reference in their entirety.

SUMMARY OF THE INVENTION

According to one aspect of the present invention, a holding sealing material includes a plurality of mats. The plurality of mats have a longitudinal direction and include a lower mat and an upper mat laminated on the lower mat. Each of the plurality of mats includes inorganic fibers and has a substantially rectangular shape. A length of the lower mat in the longitudinal direction is longer than a length of the upper mat in the longitudinal direction. Each of the plurality of mats is connected to each other at at least two fixed portions. The at least two fixed portions are positioned at different positions in the longitudinal direction.

According to another aspect of the present invention, a method for manufacturing a holding sealing material includes laminating a plurality of mats. The plurality of mats have a longitudinal direction and include a lower mat and an upper mat to be laminated on the lower mat. Each of the plurality of mats includes inorganic fibers and has a substantially rectangular shape. A length of the lower mat in the longitudinal direction is longer than a length of the upper mat in the longitudinal direction. Each of the plurality of mats is connected to each other at at least two fixed portions. The at least two fixed portions are positioned at different positions in the longitudinal direction.

According to further aspect of the present invention, an exhaust gas purifying apparatus includes an exhaust gas treating body, a casing, and a holding sealing material. The exhaust gas treating body includes cell walls longitudinally extending to define cells. The casing accommodates the exhaust gas treating body. The holding sealing material is provided between the exhaust gas treating body and the casing to hold the exhaust gas treating body. The holding sealing material includes a plurality of mats. The plurality of mats have a longitudinal direction and include a lower mat and an upper mat laminated on the lower mat. Each of the plurality of mats includes inorganic fibers and has a substantially rectangular shape. A length of the lower mat in the longitudinal direction is longer than a length of the upper mat in the longitudinal direction. Each of the plurality of mats is connected to each other at at least two fixed portions. The at least two fixed portions are positioned at different positions in the longitudinal direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
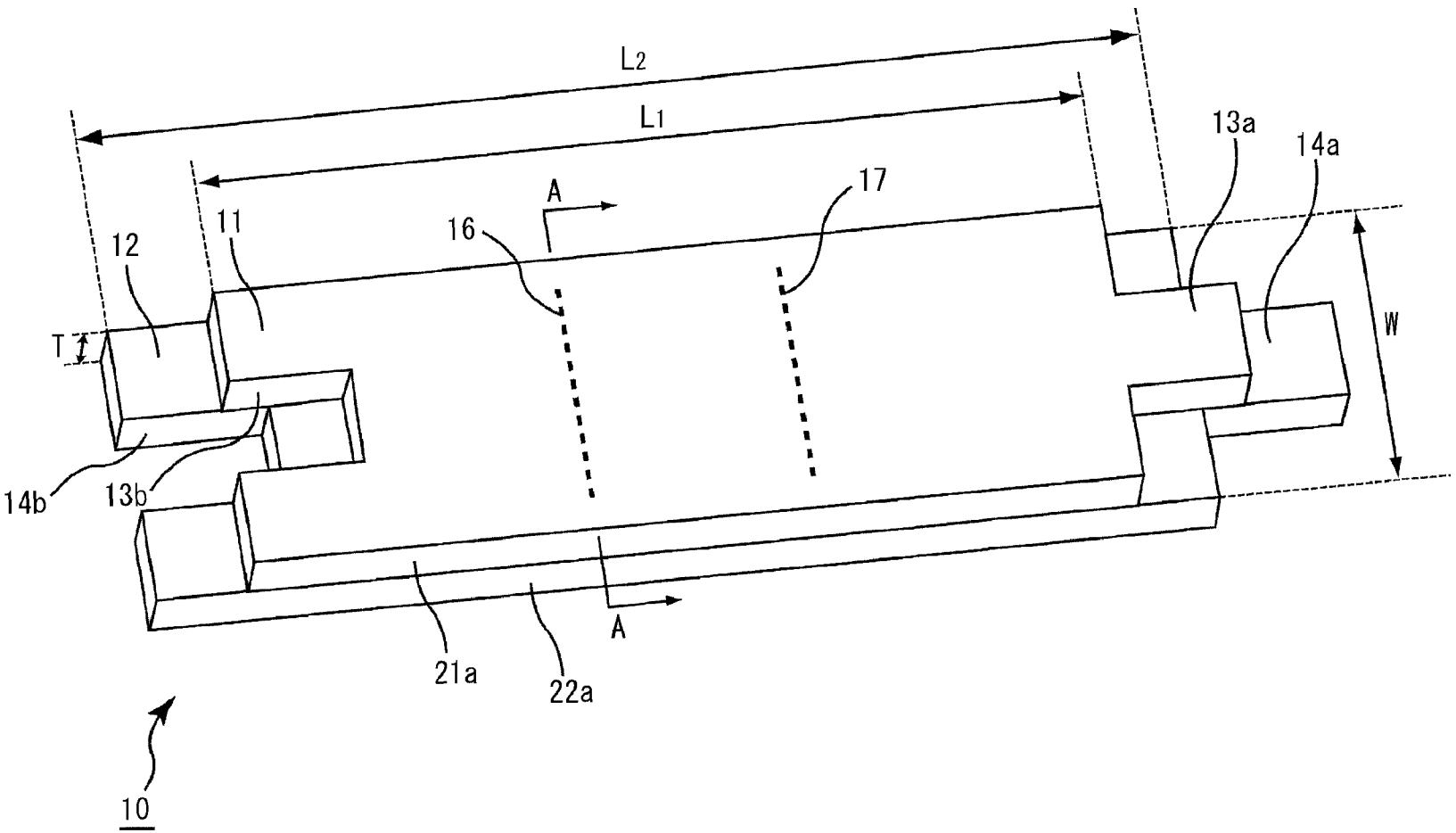
FIG. 1 is a perspective view schematically illustrating a holding sealing material according to one embodiment of the present invention.

Embodiments will now be described with reference to the accompanying drawings, wherein like reference numerals designate corresponding or identical elements throughout the various drawings.

A holding sealing material according to embodiments of the present invention includes: a plurality of mats including inorganic fibers and having a substantially rectangular shape in a plan view, the plurality of mats being laminated, wherein a length of a lower one of the plurality of mats in its longitudinal direction is longer than a length of an upper one of the plurality of mats in its longitudinal direction upon the upper one of the plurality of mats being laminated on the lower one of the plurality of mats, the plurality of mats are fixed to each other by at least two fixed portions, and in a projection view of the fixed portions to the side face having the longitudinal direction of the mat, at least two fixed portions out of the fixed portions are disposed at different positions in the longitudinal direction. According to this structure, the tension in the portion of the outer peripheral side of a holding sealing material is controlled and displacement between the mats is prevented.

In the holding sealing material according to the embodiments of the present invention, upon projection in a side view, since a plurality of laminated mats are fixed to each other by at least two fixed portions that are disposed at different positions in a longitudinal direction, it may be easier to prevent displacement in the width direction of each of the mats. Here, when the fixed portion is formed at one position, displacement tends to occur in the width direction of the mat around the fixed portion. The main reason is presumably that when both end portions of the holding sealing material are viewed from the fixed portion, these both end portions are free ends and tend not to regulate displacement in the width direction. In contrast, as in the holding sealing material according to the embodiments of the present invention, upon projection in a side view, since at least one more fixed portion different from the above-mentioned fixed portion is provided at a different position in the longitudinal direction, and since a fixed end portion exists on at least one end portion side when both end portions of the holding sealing material are viewed from each of the fixed portions, the degrees of freedom of displacement in the width direction tends to be greatly regulated. Thus, in the holding sealing material according to the embodiments of the present invention, displacement in the width direction of each of the mats may be prevented more easily. In addition, the prevention of displacement of each of the mats is more likely to lead to satisfactory handling property upon winding the holding sealing material around the exhaust gas treating body and also to improvement in workability.

"Projection in a side view" used herein refers to "projecting each of the fixed portions to the side face having the longitudinal direction of the mat."

In the holding sealing material according to the embodiments of the present invention, a maximum projection distance of projection distances between the fixed portions in a side view is desirably from about one twentieth to about three fourths of a longitudinal length of the shortest mat having the shortest length of the plurality of mats in a longitudinal direction thereof. When a maximum projection distance of projection distances between the fixed portions in a side view is from about one twentieth to about three fourths of a longitudinal length of the shortest mat having the shortest length of the plurality of mats in a longitudinal direction thereof, it may be easier to prevent tensile stress in the portion of the outer peripheral side and wrinkles in the portion of the inner peripheral side upon winding the holding sealing material around the exhaust gas treating body to a level satisfactory in workability and product use. When the maximum projection distance is about one twentieth or more of the longitudinal length of the shortest mat, the fixed portions tend not to come too close to each other and tend to exert displacement prevention effect different from that upon fixation at one position, and it may be easier to prevent displacement in the width direction of each of the mats. When the maximum projection distance is about three fourths or less of the longitudinal length of the shortest mat, the length of the holding sealing material located between the fixed portions corresponding to the maximum projection distance (that is, the area that is more directly influenced by tensile stress in the portion of the outer peripheral side and wrinkles in the portion of the inner peripheral side due to its fixed state; hereinafter, also referred to as a both-end fixed area) tends not to be so large, and it may be easier to buffer or absorb the difference between the peripheral length in the portion of the outer peripheral side in the holding sealing material (hereinafter, also referred to simply as the outer peripheral length) and the peripheral length in the portion of the inner peripheral side (hereinafter, also referred to simply as the inner peripheral length), a gap is less likely to be caused between both ends upon winding the holding sealing material around the exhaust gas treating body. Consequently, exhaust gases tend not to leak from the exhaust gas purifying apparatus, and/or durability thereof may be lowered.

The maximum projection distance used herein refers to the greatest projection distance of the projection distances between each of the fixed portions in a longitudinal direction axis upon projecting each of the fixed portions to the longitudinal direction axis in a side view, not to the greatest linear distance of the linear distances between each of the fixed portions.

In the holding sealing material according to the embodiments of the present invention, the fixed portion desirably exists along a width direction perpendicular to the longitudinal direction of the mat. When the fixed portion exists along a width direction perpendicular to the longitudinal direction of the mat, the fixed portion exists in the direction perpendicular to the winding direction of the holding sealing material to the exhaust gas treating body. Thereby, especially in the case of winding the holding sealing material, it may be easier to prevent the holding sealing material from being less likely to be wound by tensile stress in the portion of the outer peripheral side, and the good winding property of the holding sealing material tends to be secured. In addition, it may be easier to prevent the mat from being turned over from the longer side of the mat and more firmly prevent displacement of each of the mats.

In the holding sealing material according to the embodiments of the present invention, the fixed portion is desirably spaced apart from at least one of the longer side faces of the mat. When the fixed portion is spaced apart from at least one of the longer side faces of the mat, the fixed portion is not formed over the entire width direction, it is not necessary to carry out a fixing process on the longer side face. When the fixed portion is spaced apart from the longer side face of the mat, it may be easier to control the wear of the longer side face of the mat and the increase of the local stress generated upon handling the holding sealing material, and by extension prevent damage to the mats.

In the holding sealing material according to the embodiments of the present invention, the fixed portion is desirably formed over a range of about 50% to about 99.5% of a length of the width direction of the mat. When the fixed portion is formed over a range of about 50% to about 99.5% of a length of the width direction of the mat, it may be easier to prevent the mat including the longer side face from being damaged and simultaneously prevent the mat from being turned over from the longer side of the mat.

In the holding sealing material according to the embodiments of the present invention, the mat desirably has a thickness of about 1.5 mm to about 15 mm. When the mat has a thickness of about 1.5 mm to about 15 mm, it may be easier to maintain sufficient holding force and simultaneously prevent wrinkles from developing in the portion of the inner peripheral side and tensile stress from being increased in the portion of the outer peripheral side in comparison with the case where the thickness of the mat is increased.

In the holding sealing material according to the embodiments of the present invention, needling treatment is desirably carried out in the width direction perpendicular to the longitudinal direction. When needling treatment is carried out in the width direction perpendicular to the longitudinal direction, since the portion on which needling treatment is carried out tends to be formed with a crease in its width direction of the mats, it is easier to wind the holding sealing material around the exhaust gas treating body.

In the holding sealing material according to the embodiments of the present invention, the fixed portion is desirably formed by machine-sewing using a sewing thread. When the fixed portion is formed by machine-sewing using a sewing thread, the fixed portion tends to be formed easily and the mats are more likely to be firmly fixed to each other.

In the holding sealing material according to the embodiments of the present invention, the machine-sewing is desirably carried out by lock stitching. When the machine-sewing is carried out by lock stitching, stitches cannot be frayed easily even with some vibration upon handling, and the mats tend to be firmly fixed to each other.

In the holding sealing material according to the embodiments of the present invention, reverse stitching is desirably carried out on at least one of a starting point and an end point of the machine-sewing. When reverse stitching is carried out on at least one of a starting point and an end point of the machine-sewing, stitches cannot be frayed easily, and the mats tend to be kept firmly fixed to each other for a long period of time.

In the holding sealing material according to the embodiments of the present invention, a stitch length of the machine-sewing is desirably from about 1 mm to about 100 mm.

In the holding sealing material according to the embodiments of the present invention, the sewing thread desirably includes one of cotton and polyester. When the sewing thread includes one of cotton and polyester, after winding the holding sealing material around the exhaust gas treating body and assembling it to the exhaust gas purifying apparatus, a sewing thread is more likely to be burned down with exhaust gases that have been discharged by the first operation of internal combustion engines. Since the occurrence of local stress resulting from the remaining fixed portion tends to be prevented, it may be easier to exert the function of the holding sealing material in a stable manner for a long period of time.

In the holding sealing material according to the embodiments of the present invention, the sewing thread has a diameter of about 0.1 mm to about 5 mm. When the sewing thread has a diameter of about 0.1 mm to about 5 mm, the sewing thread is less likely to be cut, and it may be easier to form the fixed portion while minimizing the damage to the vicinity of the stitches upon sewing.

In the holding sealing material according to the embodiments of the present invention, the sewing thread desirably has a color other than a transparent color and different from a color of the mat. When the sewing thread has a color other than a transparent color and different from a color of the mat, the visibility for checking whether the fixed portion has been formed tends to be raised, and the work efficiency is more likely to be improved.

A method for manufacturing a holding sealing material according to the embodiments of the present invention includes: laminating a plurality of mats including inorganic fibers and having a substantially rectangular shape in a plan view, a length of a lower one of the plurality of mats in its longitudinal direction being longer than a length of an upper one of the plurality of mats in its longitudinal direction upon the upper one of the plurality of mats being laminated on the lower one of the plurality of mats; and fixing the plurality of laminated mats to each other by at least two fixed portions, wherein in a projection view of the fixed portions to the side face having the longitudinal direction of the mat, at least two fixed portions out of the fixed portions are disposed at different positions in the longitudinal direction.

Through the manufacturing method, it may be easier to prevent displacement in the width direction of each of the mats and suitably manufacture a holding sealing material with improved work efficiency upon winding and the like.

In the method for manufacturing a holding sealing material according to the embodiments of the present invention, in the projection view of the fixed portions to the side face having the longitudinal direction of the mat, the fixed portions are fixed with a maximum projection distance of projection distances between the fixed portions is desirably from about one twentieth to about three fourths of a longitudinal length of the shortest mat having the shortest length of the plurality of mats in a longitudinal direction thereof. When the fixed portions are fixed so that a maximum projection distance of projection distances between the fixed portions in a side view is from about one twentieth to about three fourths of a longitudinal length of the shortest mat having the shortest length of the plurality of mats in a longitudinal direction thereof, it may be easier to efficiently manufacture a holding sealing material that tends to prevent generation of the gap between both end portions after winding by absorbing the difference between the outer peripheral length and inner peripheral length in the both-end fixed area and also tends to prevent displacement in the width direction of the mat.

In the method for manufacturing a holding sealing material according to the embodiments of the present invention, the fixed portion is desirably fixed along a width direction perpendicular to the longitudinal direction of the mat. When the fixed portion is fixed along a width direction perpendicular to the longitudinal direction of the mat, it may be easier to suitably manufacture a holding sealing material that tends to prevent the mat from being turned over from the longer side of the mat. In addition, when a fixed portion is formed so as to exist along its width direction, since the fixed portion functions as a crease upon winding the holding sealing material around the exhaust gas treating body, the winding property thereof tends to be improved.

In the method for manufacturing a holding sealing material according to the embodiments of the present invention, the fixed portion is desirably spaced apart from at least one of the longer side faces of the mat. It is because since breakage and the like of inorganic fibers occur on the side face of the mat generated upon stamping the holding sealing material with a cutter or the like in the process of manufacturing a holding sealing material, the side face of the mat has a little lower strength to the external force and stress than in other portions and is more susceptible to damage. In order to solve the problem, when a fixed portion is spaced apart from the longer side face of the mat, since the fixing process can be easily carried out and the damage to the longer side face tends to be well prevented, it may be easier to obtain a holding sealing material excellent in durability to allow passage of the exhaust gases upon use thereof.

In the method for manufacturing a holding sealing material according to the embodiments of the present invention, the fixed portion is desirably formed over a range of about 50% to about 99.5% of a length of the width direction of the mat. When the fixed portion is formed over a range of about 50% to about 99.5% of a length of the width direction of the mat, it may be easier to suitably manufacture a holding sealing material that tends not to damage the longer side face and tends to prevent the mat from being turned over from the longer side of the mat.

In the method for manufacturing a holding sealing material according to the embodiments of the present invention, the mat is desirably manufactured so that it has a thickness of about 1.5 mm to about 15 mm.

In the method for manufacturing a holding sealing material according to the embodiments of the present invention, needling treatment is desirably carried out in the width direction perpendicular to the longitudinal direction. When needling treatment is carried out in the width direction perpendicular to the longitudinal direction, it may be easier to manufacture a holding sealing material as if it has a crease in the width direction of the mats. Such a holding sealing material tends to be wound around the exhaust gas treating body very easily.

In the method for manufacturing a holding sealing material according to the embodiments of the present invention, the fixed portion is desirably formed by machine-sewing using a sewing thread. When the fixed portion is formed by machine-sewing using a sewing thread, it may be easier to form the fixed portion readily and efficiently.

In the method for manufacturing a holding sealing material according to the embodiments of the present invention, the machine-sewing is desirably carried out by lock stitching. When the machine-sewing is carried out by lock stitching, the high strength of the stitches may make it easier to manufacture a holding sealing material that tends to exert the function of the holding sealing material in a stable manner for a long period of time.

In the method for manufacturing a holding sealing material according to the embodiments of the present invention, reverse stitching is desirably carried out on at least one of a starting point and an end point of the machine-sewing. When reverse stitching is carried out on at least one of a starting point and an end point of the machine-sewing, it may be easier to efficiently manufacture a holding sealing material in which stitches forming the fixed portion are less likely to be frayed.

In the method for manufacturing a holding sealing material according to the embodiments of the present invention, the mats are desirably stitched to each other so that a stitch length of the machine-sewing is from about 1 mm to about 100 mm.

In the method for manufacturing a holding sealing material according to the embodiments of the present invention, the sewing thread including one of cotton and polyester is desirably used as a sewing thread. When the sewing thread including one of cotton and polyester is used as a sewing thread, a fixed portion having high strength may be formed more easily.

In the method for manufacturing a holding sealing material according to the embodiments of the present invention, the sewing thread desirably has a diameter of about 0.1 mm to about 5 mm. When the sewing thread has a diameter of about 0.1 mm to about 5 mm, it may be easier to eliminate the possibility of cutting upon the work of a sewing thread and to form a fixed portion with favorable handle ability.

In the method for manufacturing a holding sealing material according to the embodiments of the present invention, the sewing thread desirably has a color other than a transparent color and different from a color of the mat. When the sewing thread has a color other than a transparent color and different from a color of the mat, it may be easier to readily check whether the fixed portion has been formed, in the process of manufacturing the holding sealing material.

An exhaust gas purifying apparatus according to the embodiments of the present invention includes: an exhaust gas treating body in which a large number of cells are longitudinally disposed in parallel with one another with a cell wall interposed therebetween; a casing configured to accommodate the exhaust gas treating body; and a holding sealing material provided between the exhaust gas treating body and the casing and configured to hold the exhaust gas treating body, wherein the holding sealing material includes a plurality of mats including inorganic fibers and having a substantially rectangular shape in a plan view, the plurality of mats being laminated, wherein a length of a lower one of the plurality of mats in its longitudinal direction is longer than a length of an upper one of the plurality of mats in its longitudinal direction upon the upper one of the plurality of mats being laminated on the lower one of the plurality of mats, the plurality of mats are fixed to each other by at least two fixed portions, and in a projection view of the fixed portions to the side face having the longitudinal direction of the mat, at least two fixed portions out of the fixed portions are disposed at different positions in the longitudinal direction. Since the holding sealing material according to the embodiments of the present invention is used as a holding sealing material, it may be easier to prevent tensile stress from being increased in the portion of the outer peripheral side and wrinkles from developing in the portion of the inner peripheral side upon winding the holding sealing material around the exhaust gas treating body, and consequently to prevent leakage of exhaust gases, deterioration of durability, and the like in the entire exhaust gas purifying apparatus.

First Embodiment

The following will discuss a first embodiment, one embodiment of a holding sealing material and a method for manufacturing a holding sealing material according to the present invention, with reference to the drawings.

FIG. 1 is a perspective view illustrating the holding sealing material according to one embodiment of the present invention. As illustrated in FIG. 1, in a holding sealing material 10 of the present embodiment, two mats 11 and 12 having a substantially rectangular shape in a plan view and having a predetermined length (hereinafter, simply referred to as a full length, and indicated by arrows $L_1$ and $L_2$ in FIG. 1) in a longitudinal direction, a width (indicated by an arrow W in FIG. 1), and a thickness (indicated by an arrow T in FIG. 1) are laminated. Upon measuring the full length, a size of a projected portion or a recessed portion formed at end portions of the mats are not taken into consideration.

In addition, projected portions 13*a* and 14*a* are formed at one end portion out of the end portions of the mats 11 and 12, and recessed portions 13*b* and 14*b* are formed at the other end portion. The projected portion 13*a* and the recessed portion 13*b* of the mat 11, and the projected portion 14*a* and the recessed portion 14*b* of the mat 12 have such shapes that they are perfectly fitted to each other upon winding the holding sealing material 10 around the exhaust gas treating body.

The mats 11 and 12 are prepared as needle mats obtained by carrying out needling treatment on a base mat including inorganic fibers. The needling treatment refers to a process in which a fiber entangling means such as a needle is inserted into and removed from the base mat. In the mats 11 and 12, inorganic fibers having a comparatively long average fiber length are entangled with one another three-dimensionally by the needling treatment. The needling treatment is performed on these mats in the width direction perpendicular to the longitudinal direction.

Moreover, the inorganic fibers have a certain average fiber length to form the entangled structure, and, for example, the average fiber length of the inorganic fibers is from about 50 μm to about 100 mm.

The holding sealing material of the present embodiment may contain a binder such as an organic binder, so as to suppress the volume of the holding sealing material and to enhance the workability prior to the assembling processes of the exhaust gas purifying apparatus.

Here, two mats having a thickness of about 1.5 mm to about 15 mm are laminated in the holding sealing material 10 illustrated in FIG. 1, and the number of mats to be laminated is not particularly limited and may be three or more. A mat (hereinafter, also referred to as the shortest mat) having the shortest full length out of a plurality of mats is a mat to be wound on the periphery of the exhaust gas treating body. Subsequently, a mat having a full length longer than that of the shorter mat is laminated, and thereafter, a mat having a longer full length is sequentially laminated thereon. Here, the mat 11 is referred to as the shortest mat even in the case where the holding sealing material 10 as illustrated in FIG. 1 is configured by the two mats 11 and 12.

Figure 2A:
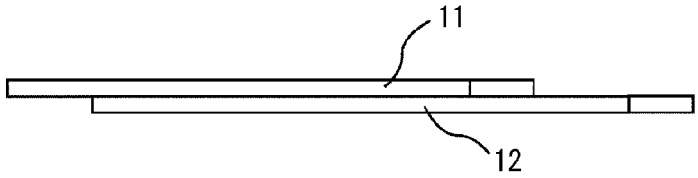
FIG. 2A is a side view schematically illustrating a state in which two mats are laminated.
Figure 2B:
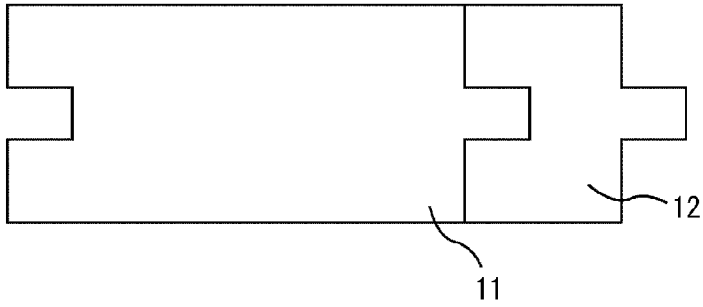
FIG. 2B is a plan view schematically illustrating a state where the two mats are laminated.

Here, the embodiment of lamination of mats is not limited to an embodiment as illustrated in FIG. 1 in which the mat 11 is laminated on the mat 12 so as not to stick out of either one of the ends of the mat 12 in a plan view, and may be an embodiment as illustrated in FIGS. 2A and 2B. FIG. 2A is a side view schematically illustrating another state in which two mats are laminated, and FIG. 2B is a plan view schematically illustrating a state where the two mats are laminated. In the embodiment illustrated in FIG. 2A, the mat 11 and the mat 12 having a full length longer than that of the mat 11 are laminated so as to be displaced relative to each other in the longitudinal direction. In a plan view, the mat 11 will be laminated at a position that sticks out of the left end of the mat 12 of the drawing, as illustrated in FIG. 2B.

In the holding sealing material of the present embodiment, the mat 11 and the mat 12 are fixed to each other by two fixed portions, i.e., a fixed portion 16 and a fixed portion 17. As illustrated in FIG. 1, the fixed portions 16 and 17 configured to fix the mats 11 and 12 are spaced apart a predetermined length from longer side faces 21*a* and 22*a*, and continuously extend so as to make up about 50% to about 99.5% of the length of the width direction of the shortest mat 11. The fixing method in the holding sealing material of the present embodiment is machine-sewing, whereby the mats 11 and 12 are firmly fixed to each other.

Figure 3:
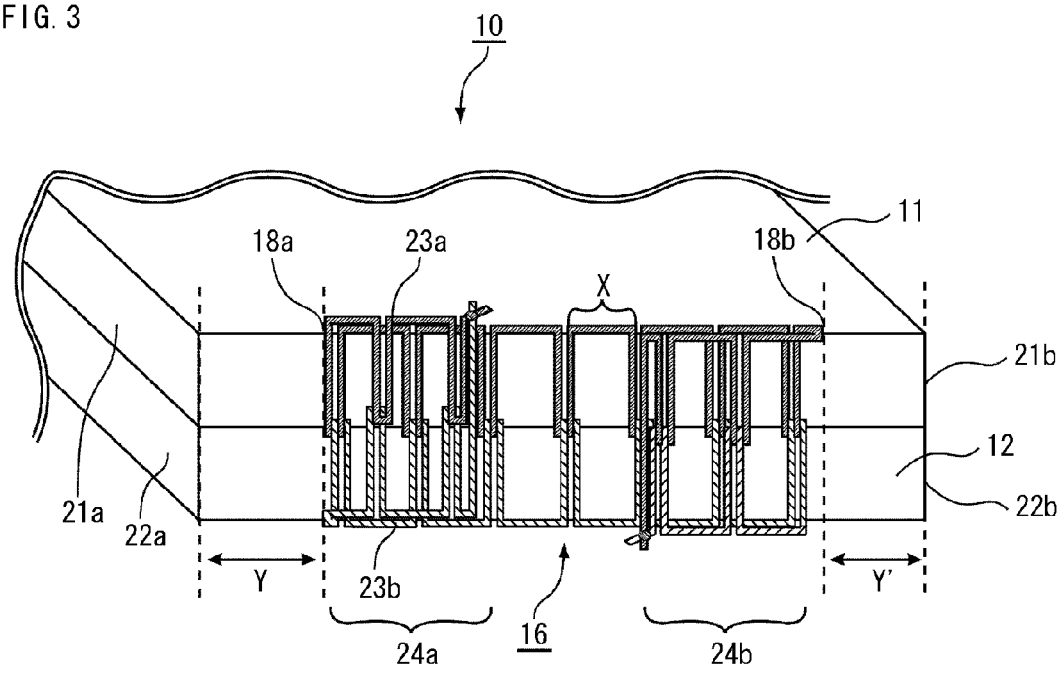
FIG. 3 is an A-A line cross-sectional view of the holding sealing material of the present embodiment illustrated in FIG. 1.

Next, machine-sewing will be described in detail with reference to FIG. 3. FIG. 3 is an A-A line cross-sectional view of a holding sealing material of the present embodiment illustrated in FIG. 1. As illustrated in FIG. 3, the fixed portion 16 is formed by lock stitching (machine-sewing) with sewing threads 23*a* (an upper thread) and 23*b* (a bobbin thread).

Each of the sewing threads 23*a* and 23*b* has a diameter of about 0.1 mm to about 5 mm and includes cotton or polyester. Moreover, its color is other than a transparent color and differs from the color of the mats 11 and 12. When the mats 11 and 12 are white, for example, the color of the sewing threads 23*a* and 23*b* is not particularly limited and may be red, blue, yellow, green, black, or the like.

Reverse stitching is carried out on the areas 24*a* and 24*b* including a starting point and an end point of the machine-sewing, and a sewing thread is less likely to be frayed at the end portion of the fixed portion even after machine-sewing. The stitch length (indicated by X in FIG. 3) is from about 1 mm to about 100 mm.

In addition, one end portion 18*a* of the fixed portion 16 is spaced apart from longer side faces 21*a* and 22*a* of the mats 11 and 12, and the other end portion 18*b* is also spaced apart from longer side faces 21*b* and 22*b* of the mats 11 and 12. The shortest distance (indicated by a double-pointed arrow Y in FIG. 3) between one end portion 18*a* of the fixed portion 16 and the longer side faces 21*a* and 22*a* of the mats 11 and 12 is from about 1% to about 49% of the length of the mats 11 and 12 in the width direction. Similarly, the shortest distance (indicated by a double-pointed arrow Y' in FIG. 3) between the other end portion 18*b* of the fixed portion 16 and the longer side faces 21*a* and 22*a* of the mats 11 and 12 is from about 1% to about 49% of the length of the mats 11 and 12 in the width direction.

Here, the end portions 18*a* and 18*b* of the fixed portion are desirably spaced apart from the longer side faces 21*a*, 22*a*, 21*b*, and 22*b* but may not be spaced apart therefrom as long as satisfactory product use is available in consideration of the influence on the mats.

Figure 4A:
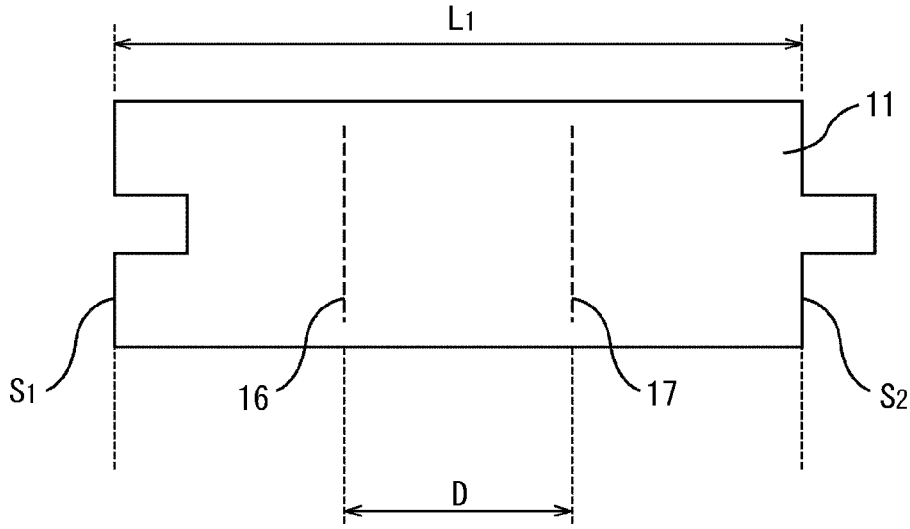
FIG. 4A is a plan view schematically illustrating the shortest mat that configures a holding sealing material according to one embodiment of the present invention.

In the holding sealing material of the present embodiment, a plurality of mats are fixed to each other by at least two fixed portions. In a projection view of the fixed portions to the side face having the longitudinal direction of the mat, at least two fixed portions out of the above-mentioned fixed portions are disposed at different positions in the longitudinal direction. The positional relationship of this fixed portion will be described with reference to FIGS. 4A and 4B. FIG. 4A is a plan view schematically illustrating the shortest mat that configures a holding sealing material according to one embodiment of the present invention, and FIG. 4B is an axial projection view schematically illustrating the positional relationship of the fixed portion obtained by projecting the shortest mat of FIG. 4A on a longitudinal axis in a side view.

First, as illustrated in FIG. 4A, the fixed portions 16 and 17 are formed in the shortest mat 11. As a fixed portion, there exist the fixed portion 16 formed closer to a first shorter side $S_1$ of the shortest mat 11 and the fixed portion 17 formed closer to a second shorter side $S_2$ of the shortest mat 11.

Figure 4B:
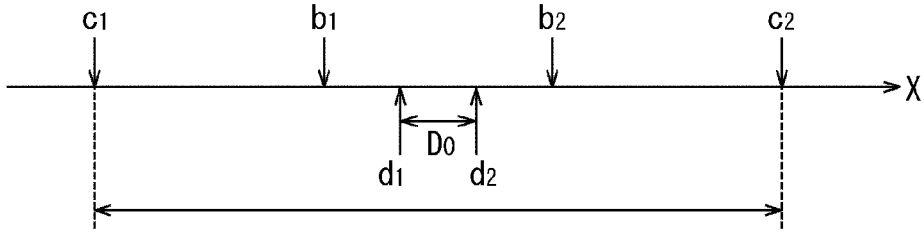
FIG. 4B is an axial projection view schematically illustrating the positional relationship of the fixed portion obtained by projecting the shortest mat of FIG. 4A on a longitudinal axis in a side view.

When the fixed portions 16 and the fixed portion 17 are projected in a longitudinal axis X in a side view, as illustrated in FIG. 4B, the fixed portion 16 and the fixed portion 17 are disposed so as to correspond to the positions of the arrow $b_1$ and the arrow $b_2$ on the longitudinal axis X, respectively. That is, the fixed portion 16 and the fixed portion 17 projected on the longitudinal axis X are not overlapped with each other on a projection axis and are disposed at different positions in the longitudinal direction.

In the method for manufacturing a holding sealing material, in the projection view of the fixed portions to the side face having the longitudinal direction of the mat, the fixed portions are fixed with a maximum projection distance of projection distances between the fixed portions being from about one twentieth to about three fourths of a longitudinal length of the shortest mat having the shortest length of the plurality of mats in a longitudinal direction thereof. In order to define this maximum projection distance, attention should be focused on the full length of the shortest mat of the laminated mats. Hereinafter, description will be given centering on the shortest mat. As described with reference to FIG. 4B, in the longitudinal axis X, the fixed portion 16 and the fixed portion 17 are disposed so as to correspond to the positions of the arrow $b_1$ and the arrow $b_2$ on the longitudinal axis X, respectively. In the holding sealing material of the present embodiment, the projection distance D between the arrow $b_1$ and the arrow $b_2$ is from about one twentieth to about three fourths of the full length $L_1$ (that is, the distance between an arrow $c_1$ and an arrow $c_2$ in FIG. 4B of the shortest mat 11. In the present embodiment, since only two fixed portions exist, the projection distance D between the fixed portion 16 and the fixed portion 17 corresponds to the maximum projection distance.

FIG. 4B illustrates the embodiment in which the maximum projection distance D is about one third of the full length $L_1$ of the shortest mat 11 for convenience of description. In the case where the maximum projection distance D is, for example, about one twentieth of the full length $L_1$, the positions corresponding to the fixed portion 16 and the fixed portion 17 on the longitudinal axis X are an arrow $d_1$ and an arrow $d_2$, respectively, and the maximum projection distance is the distance indicated by $D_0$.

The maximum projection distance D is not particularly limited. In the case where it is about one twentieth or more of the full length $L_1$ of the shortest mat 11, since two fixed portions are not focused at one position to the breadth of the entire mat, it may be easier to prevent displacement in the width direction of each of the mats. On the other hand, when the maximum projection distance D is about three fourths or less of the full length $L_1$ of the shortest mat 11, a both-end fixed area, an area (area that exists between the arrow $b_1$ and the arrow $b_2$) between the fixed portion 16 and the fixed portion 17, does not become too large. Then, since the influence of the difference between the inner peripheral length and the outer peripheral length in the both-end fixed area, which can be ignored when the maximum projection distance is small, becomes smaller, tensile stress tends not to occur in the portion of the outer peripheral side and wrinkles is developed in the portion of the inner peripheral side upon winding the holding sealing material around the exhaust gas treating body. Therefore, the maximum projection distance D is desirably from about one twentieth to about three fourths of the full length $L_1$ of the shortest mat 11.

Here, the full length $L_1$ of the shortest mat 11 is a length such that both end portions thereof are fitted to each other upon winding the holding sealing material around the exhaust gas treating body. In other words, the full length $L_1$ of the shortest mat 11 is equivalent to the circumferential length of the exhaust gas treating body. Since the maximum projection distance D which is about one twentieth of the full length $L_1$ is equal to the circle length of the range of about one twentieth of the circumferential length, the circumferential angle of the circle is about 18°. Similarly, since the maximum projection distance D which is about three fourths of the full length $L_1$ is equal to the circle length of the range of about three fourths of the circumferential length, the circumferential angle of the circle is about 270°. Thus, the position of the fixed portion of the holding sealing material of the present embodiment can be defined by the circumferential angle on the cross section of the exhaust gas treating body. The definition makes it possible for the shape of the holding sealing material and the like to respond flexibly to the exhaust gas treating body having various sizes, curvatures, and the like.

Next, the configuration of the exhaust gas purifying apparatus of the present embodiment using the holding sealing material of the present embodiment will be described with reference to FIG. 5A and FIG. 5B.

Figure 5A:
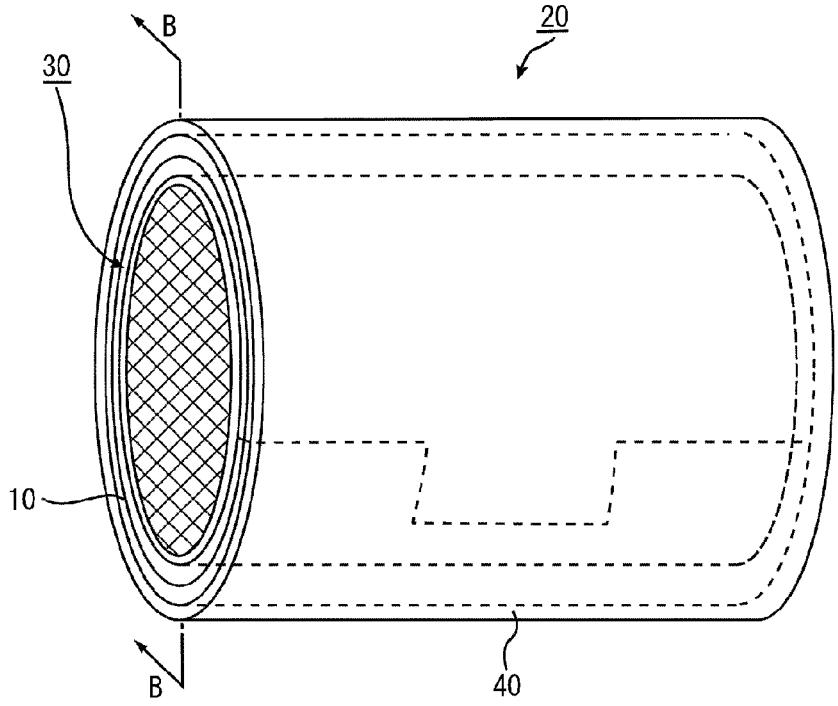
FIG. 5A is a perspective view schematically illustrating an exhaust gas purifying apparatus of the present embodiment.
Figure 5B:
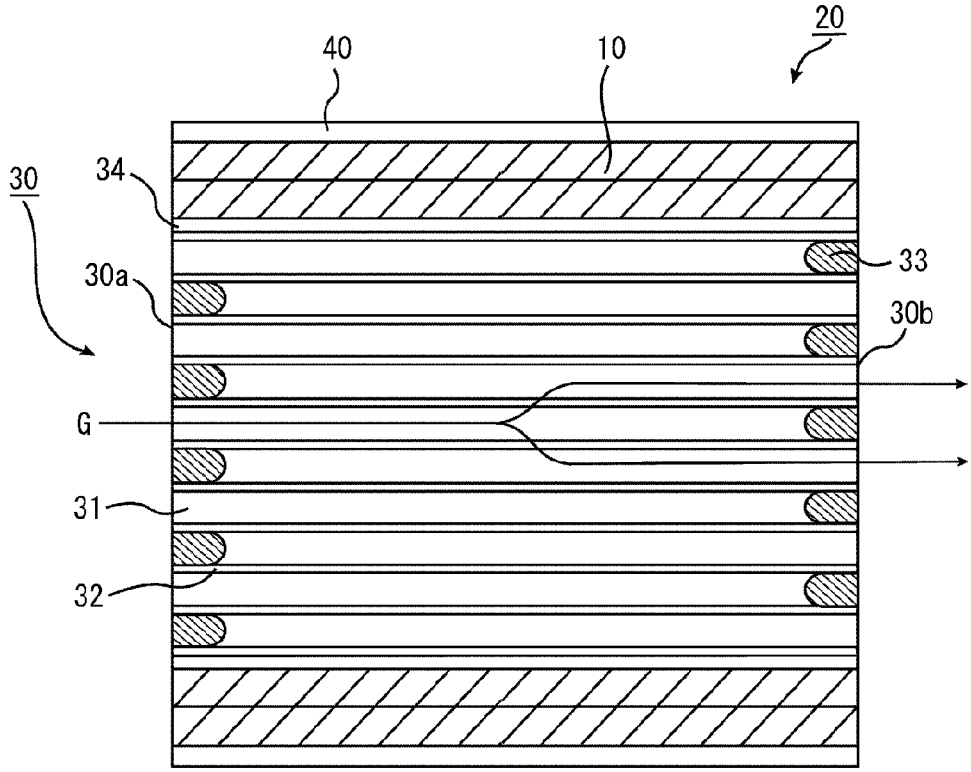
FIG. 5B is a B-B line cross-sectional view of the exhaust gas purifying apparatus illustrated in FIG. 5A.

FIG. 5A is a perspective view schematically illustrating an exhaust gas purifying apparatus of the present invention, and FIG. 5B is a B-B line cross-sectional view of the exhaust gas purifying apparatus illustrated in FIG. 5A.

As illustrated in FIG. 5A and FIG. 5B, an exhaust gas purifying apparatus 20 includes: an exhaust gas treating body 30 in which a large number of cells 31 are longitudinally disposed in parallel with one another with a cell wall 32 interposed therebetween; a casing 40 configured to accommodate the exhaust gas treating body 30; and a holding sealing material 10 provided between the exhaust gas treating body 30 and the casing 40 and configured to hold the exhaust gas treating body 30.

If needed, to the end portions of the casing 40 are connected: an introducing pipe configured to introduce exhaust gases discharged by internal combustion engines; and an exhaust pipe with which the exhaust gases that have passed through an exhaust gas purifying apparatus are discharged to the outside.

In the exhaust gas purifying apparatus 20 of the present embodiment, as illustrated in FIG. 5B, as the exhaust gas treating body 30, a honeycomb filter is employed in which either one of the ends of each of the cells is sealed with a plug 33.

With reference to FIG. 5B, the following will discuss the case where exhaust gases pass through the exhaust gas purifying apparatus 20 having the above-mentioned configuration.

As illustrated in FIG. 5B, the exhaust gas (in FIG. 5B, the exhaust gas is indicated by G and the flow of the exhaust gas is indicated by arrows) discharged from the internal combustion engines and introduced into the exhaust gas purifying apparatus 20 flows into one cell 31 that opens onto an end face 30*a* of the exhaust gas inlet side in the honeycomb filter 30, and passes through a cell wall 32 separating the cell 31. At this time, PMs in the exhaust gas are captured in the cell wall 32, and as a result, the exhaust gas is purified. The purified exhaust gas flows out through another cell 31 opening onto the end face 30*b* of the exhaust gas outlet side, and is discharged to the outside.

Figure 6A:
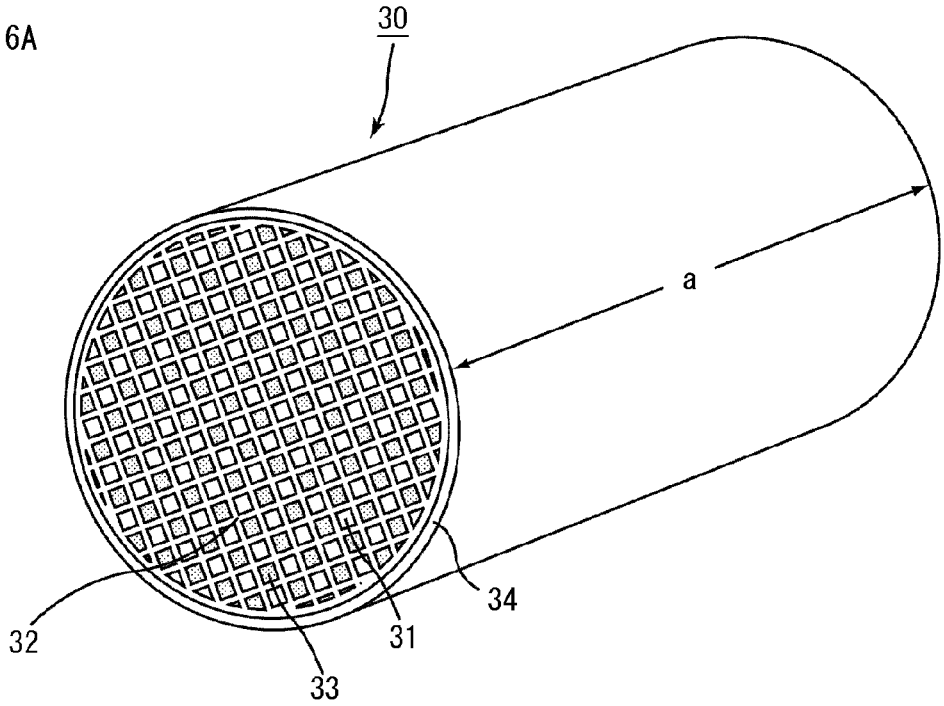
FIG. 6A is a perspective view schematically illustrating a honeycomb filter that configures an exhaust gas purifying apparatus of the first embodiment.
Figure 6B:
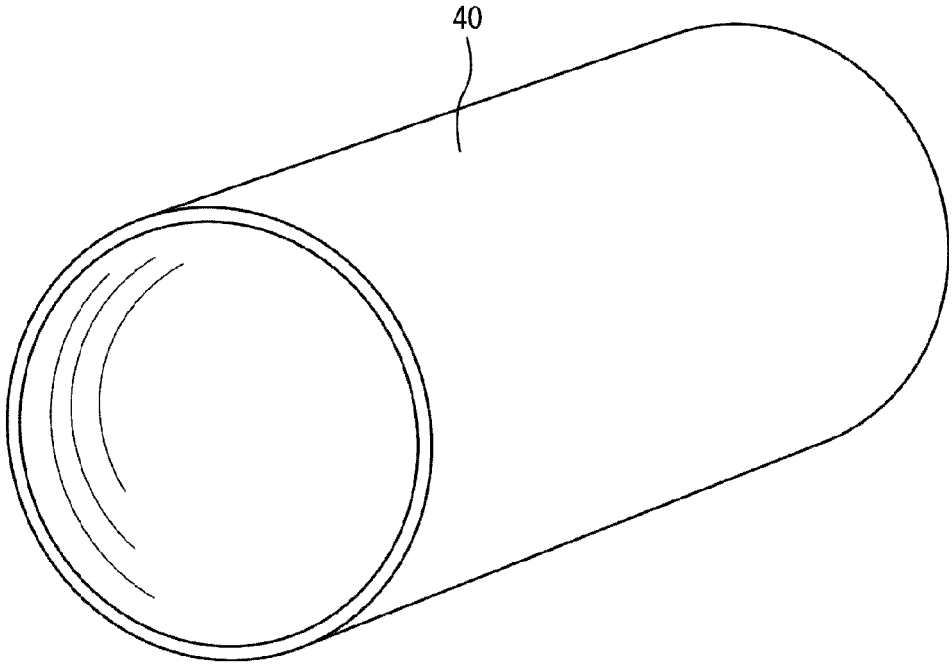
FIG. 6B is a perspective view schematically illustrating a casing that configures the exhaust gas purifying apparatus of the first embodiment.

Next, with reference to FIG. 6A and FIG. 6B, the following will discuss a honeycomb filter and a casing that configure the exhaust gas purifying apparatus 20.

Here, the configuration of the holding sealing material 10 will be omitted because it has been already stated.

FIG. 6A is a perspective view schematically illustrating a honeycomb filter that configures an exhaust gas purifying apparatus of the first embodiment, and FIG. 6B is a perspective view of a casing that configures the exhaust gas purifying apparatus of the present embodiment.

As illustrated in FIG. 6A, a honeycomb filter 30 mainly includes porous ceramics and has a substantially round pillar shape. Moreover, a sealing material layer 34 is formed on the periphery of the honeycomb filter 30 for the purposes of reinforcing the peripheral portion of the honeycomb filter 30 and adjusting the shape of the peripheral portion thereof, and improving the heat insulating property of the honeycomb filter 30.

The internal configuration of the honeycomb filter 30 has been already stated in the description of the exhaust gas purifying apparatus of the present embodiment (refer to FIG. 5B).

Subsequently, the casing 40 will be described. The casing 40, illustrated in FIG. 6B, is mainly made of metal such as stainless, and it is formed into a substantially circular cylindrical shape. Moreover, its inner diameter is slightly shorter than the total combined length of the diameter of the end face of the honeycomb filter 30 and the thickness of the holding sealing material 10 wound around the honeycomb filter 30, and its length is substantially the same as the length of the honeycomb filter 30 in the longitudinal direction (direction indicated by an arrow a in FIG. 6A).

Next, the following description will discuss a method for manufacturing a holding sealing material and an exhaust gas purifying apparatus of the present embodiment.

First, a method for manufacturing a holding sealing material will be described. The method for manufacturing a holding sealing material according to the present embodiment includes: laminating a plurality of mats including inorganic fibers and having a substantially rectangular shape in a plan view, a length of a lower one of the plurality of mats in its longitudinal direction being longer than a length of an upper one of the plurality of mats in its longitudinal direction upon the upper one of the plurality of mats being laminated on the lower one of the plurality of mats; and fixing the plurality of laminated mats to each other by at least two fixed portions, wherein in a projection view of the fixed portions to the side face having the longitudinal direction of the mat, at least two fixed portions out of the fixed portions are disposed at different positions in the longitudinal direction.

First, needle mats having predetermined overall lengths are prepared as mats that form a holding sealing material. Each of the needle mats is manufactured by carrying out the needling treatment on a base mat. The base mat has a structure in which inorganic fibers having a predetermined average fiber length are loosely entangled with one another through a spinning process. By carrying out the needling treatment on the inorganic fibers thus loosely entangled with one another, the inorganic fibers are entangled with one another complicatedly so that a mat having an entangled structure that can maintain its shape to a certain degree without the presence of binder tends to be formed.

The inorganic fibers that form the mats are not particularly limited, and may be alumina-silica fibers, or may be alumina fibers, silica fibers, or the like. It is necessary to change heat resistance, resistance to wind erosion, and the like based on the characteristics and the like required of the holding sealing material. In the case of using alumina-silica fibers as inorganic fibers, for example, the fibers can be used in which the composition ratio of alumina to silica is about (60:40) to about (80:20).

The needling treatment can be carried out by using a needling device. The needling device is configured by: a supporting plate for supporting the base mat; and a needle board that is disposed above this supporting plate and capable of moving in a reciprocating manner in a sticking direction (thickness direction of the base mat). A large number of needles are attached to the needle board. This needle board is shifted relative to the base mat mounted on the supporting plate, and the large number of needles are inserted into and removed from the base mat so that the inorganic fibers forming the base mat tend to be entangled complicatedly. The number of the needling treatments and the number of the needles can be altered in accordance with the target bulk density, weight per square meter, and the like.

This needling treatment is performed on a plurality of base mats having different lengths to manufacture a plurality of mats required for the holding sealing material according to the embodiments of the present invention. Here, since the full length of the shortest mat that is to be wound around the exhaust gas treating body corresponds to the circumferential length of the exhaust gas treating body, the full length of the shortest mat is determined based on the circumferential length of the exhaust gas treating body in the first place. Since the full length of a mat that is to be located outside the shortest mat corresponds to the circumferential length associated with the diameter which is obtained by adding the thickness of the shortest mat wound around the exhaust gas treating body to the diameter of the exhaust gas treating body, the full length of the mat located outside the shortest mat is determined by obtaining the circumferential length in the second place. Each of the full lengths of a plurality of mats to be laminated is determined by repeating the above-described procedure.

Thus, if necessary, a binder is allowed to adhere to the mats that have undergone needling treatment. By adhering the binder to the mats, the entangled structure among the inorganic fibers tend to be firmer, and the volume of the mats tends to be suppressed.

An emulsion, prepared by dispersing acrylic latex, rubber latex, or the like in water, may be used as the binder. This binder is sprayed evenly over the entire mat by using a spray or the like so that the binder is allowed to adhere to the mat.

Thereafter, in order to remove moisture contained in the binder, the mat is dried. As the drying condition, it is necessary to dry the binder for about 1 minute to about 30 minutes at about 95° C. to about 150° C., for example. The mat of the present embodiment can be manufactured through the drying process.

The plurality of mats thus manufactured are laminated in the order of a mat with a shorter length to a mat with a longer length or vice versa. The number of mats to be laminated can be changed depending on the holding force and heat insulating property that are required for the holding sealing material. A typical exemplary lamination order is such that a mat with the longest full length is initially prepared, and then mats are sequentially laminated thereon so that the upper mat laminated on the lower mat has a full length shorter than that of the lower mat. The relative position of the mats to be laminated may be such that: the upper mat to be laminated having the shorter full length may not stick out of either one of the ends of the lower mat having the longer full length; or the upper mat may stick out of either one of the ends of the lower mat having the longer full length because of mutual displacement in the longitudinal direction.

Next, a plurality of laminated mats are fixed to each other. At this moment, a fixing process such as machine-sewing is performed on a plurality of laminated mats at at least two positions, so that a plurality of mats are fixed to each other. Here, at least two fixed portions out of the fixed portions are disposed at different positions in the longitudinal direction upon projection in a side view.

In the case where the fixed portion is formed by machine-sewing, for example, it is necessary to perform lock stitching, in which its stitch length is about 10 mm, by using a sewing thread having a diameter of about 1 mm and a purplish red color and using a Z twist as a second twist, and to perform reverse stitching in the end portion of the fixed portion. In addition, both end portions of the fixed portion are spaced apart about 10 mm from the longer side face of the mat, and machine-sewing is carried out so that the length of the fixed portion is set to about 275 mm.

Here, in the case of machine-sewing, these mats tend to be fixed by laminating a plurality of mats. Here, upon using an adhesive, for example, a mark may be put (by standing a stick in parallel with a lamination direction at the position corresponding to the fixed portion on the side face of the mat, and the like, for example) so as to correspond to the position of the fixed portion, and then the two mats, the upper and lower mats, may be sequentially fixed with an adhesive along the mark.

Referring to the drawings, the following description will discuss a method for manufacturing an exhaust gas purifying apparatus.

Figure 7:
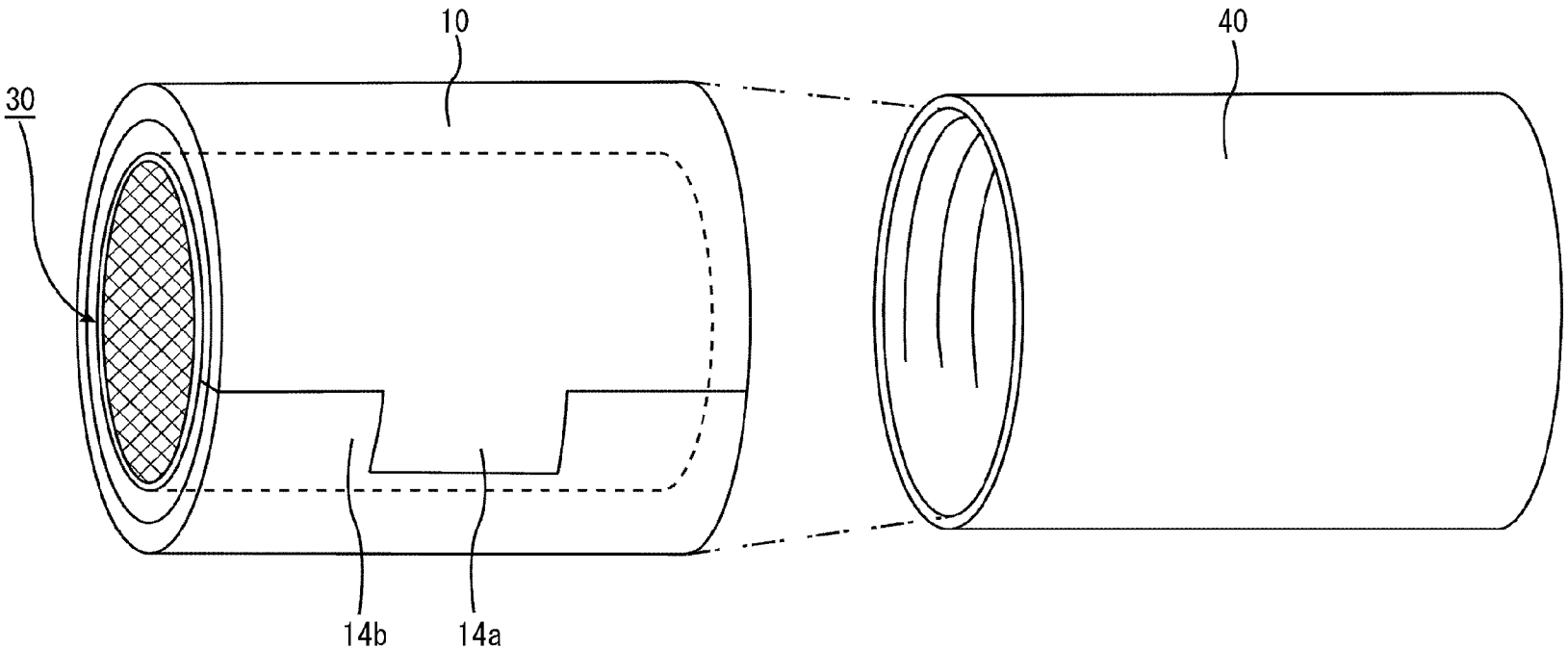
FIG. 7 is a perspective view schematically illustrating the procedure of manufacturing an exhaust gas purifying apparatus of the present embodiment.

FIG. 7 is a perspective view schematically illustrating the procedure of manufacturing an exhaust gas purifying apparatus of the present embodiment.

A holding sealing material 10, manufactured through the processes, is wound around the periphery of a substantially round pillar-shaped honeycomb filter 30 manufactured by a conventionally known method, with its projected portion 14*a* and recessed portion 14*b* being fitted to each other. Then, as illustrated in FIG. 7, the honeycomb filter 30 around which the holding sealing material 10 has been wound is press-fitted into a casing 40 with a round pillar shape having a predetermined size, mainly made of metal and the like; thus, an exhaust gas purifying apparatus is manufactured.

In order to compress the holding sealing material 10 after the press fitting and exert a predetermined repulsive force (that is, force for holding a honeycomb filter 30), the internal diameter of the casing 40 is a little smaller than the diameter of the outermost diameter including the thickness of the holding sealing material 10 of the honeycomb filter 30 around which the holding sealing material 10 has been wound.

In the holding sealing material of the present embodiment, since a plurality of mats are fixed to each other at the predetermined fixed portions, upon winding the holding sealing material around the exhaust gas treating body, there is less displacement in the width direction, leading to favorable handlability. Thereby, since it is not necessary to attend displacement of the mats, production efficiency of the exhaust gas purifying apparatus also tends to be improved.

Hereinafter, the effects of the holding sealing material exhaust gas purifying apparatus according to the present embodiment will be described.

(1) In the holding sealing material of the present embodiment, a plurality of laminated mats are fixed to each other by at least two fixed portions. In a projection view of the fixed portions to the side face having the longitudinal direction of the mat, at least two fixed portions out of the above-mentioned fixed portions are disposed at different positions in the longitudinal direction. Therefore, it may be easier to prevent displacement of each of the mats in the width direction. In addition, prevention of such displacement of each of the mats tends to result in favorable handlability upon winding the holding sealing material around the exhaust gas treating body and also in improved workability.

(2) In the holding sealing material of the present embodiment, in the projection view of the fixed portions to the side face having the longitudinal direction of the mat, the fixed portions are fixed with a maximum projection distance of projection distances between the fixed portions being from about one twentieth to about three fourths of a longitudinal length of the shortest mat having the shortest length of the plurality of mats in a longitudinal direction thereof. Therefore, by absorbing the difference between the outer peripheral length and inner peripheral length in the both-end fixed area, it may be easier to prevent generation of the gap between both end portions upon winding the holding sealing material around the exhaust gas treating body to a level satisfactory in workability and product use.

(3) Since the fixed portion exists along the longitudinal direction of the mat, the fixed portion exists in the direction perpendicular to the winding direction of the holding sealing material to the exhaust gas treating body. Thereby, especially in the case of winding the holding sealing material, it may be easier to prevent the holding sealing material from being less likely to be wound by tensile stress in the portion of the outer peripheral side, and the good winding property of the holding sealing material tends to be secured. In addition, it may be easier to prevent the mat from being turned over from the longer side of the mat and prevent displacement of each of the mats.

(4) When the fixed portion is spaced apart from at least one of the longer side faces of the mat, since the fixed portion is not formed over the entire width direction, it is not necessary to carry out a fixing process on the longer side face. When the fixed portion is spaced apart from the longer side face of the mat, it may be easier to control the wear of the longer side face of the mat and the local stress generated upon handling the holding sealing material, and by extension prevent damage to the mats.

(5) Since the fixed portion is formed over a range of about 50% to about 99.5% of a length of the width direction of the mat, it may be easier to prevent the mat including the longer side face from being damaged and simultaneously prevent the mat from being turned over from the longer side of the mat.

(6) Since the mat has a thickness of about 1.5 mm to about 15 mm, it may be easier to maintain sufficient holding force and simultaneously prevent wrinkles from developing in the portion of the inner peripheral side and tensile stress from being increased in the portion of the outer peripheral side in comparison with the case where the thickness of the mat is increased.

(7) Since needling treatment is carried out in the width direction perpendicular to the longitudinal direction, and the portion on which needling treatment is carried out is formed with a crease in its width direction of the mat, it may be easier to wind the holding sealing material around the exhaust gas treating body.

(8) Since the fixed portion is formed by machine-sewing using a sewing thread, the fixed portion tends to be formed easily and the mats tend to be firmly fixed to each other. In addition, since the machine-sewing is carried out by lock stitching, stitches cannot be frayed easily even with some vibration upon handling, and the mats tend to be firmly fixed to each other.

(9) In the holding sealing material according to the present embodiment, since reverse stitching is carried out on at least one of a starting point and an end point of the machine-sewing, stitches cannot be frayed easily, and the mats tend to be kept firmly fixed to each other for a long period of time.

(10) The sewing thread includes cotton or polyester. Therefore, after winding the holding sealing material around the exhaust gas treating body and assembling it to the exhaust gas purifying apparatus, a sewing thread tends to be burned down with exhaust gases that have been discharged by the first operation of internal combustion engines. Here, since the occurrence of local stress resulting from the remaining fixed portion tends to be prevented, it may be easier to exert the function of the holding sealing material in a stable manner for a long period of time.

(11) When the sewing thread has a diameter of about 0.1 mm to about 5 mm, the sewing thread is less likely to be cut, and it may be easier to form the fixed portion while minimizing the damage to the vicinity of the stitches upon sewing.

(12) The sewing thread has a color other than a transparent color and different from a color of the mat. Therefore, the work efficiency tends to be improved by more easily raising the visibility for checking whether the fixed portion has been formed.

(13) When the holding sealing material according to the embodiments of the present invention is used as a holding sealing material in an exhaust gas purifying apparatus, since the holding sealing material of the present invention is used as the holding sealing material, it may be easier to prevent tensile stress from being increased in the portion of the outer peripheral side and wrinkles from developing in the portion of the inner peripheral side upon winding the holding sealing material around the exhaust gas treating body, and consequently to prevent leakage of the exhaust gases and deterioration of durability in the entire exhaust gas purifying apparatus.

The following description will discuss Examples that specifically disclose the first embodiment of the present invention. Here, the present invention is not intended to be limited only by these Examples.

Example 1

A base mat having a compounding ratio of $Al_2O_3$:$SiO_2$=72:28 was prepared as a base mat made of alumina fibers having an alumina-silica composition. The needle treating mat having a bulk density of 0.15 g/cm$^3$, and a weight per square meter of 1050 g/m$^2$ was manufactured by carrying out needling treatment on this base mat.

Separately, as the binder, the binder obtained by preparing an acrylic latex emulsion by sufficiently dispersing an acrylic latex in water was used.

Then, a needle treating mat was cut into a size of 1054 mm in full length of ×295 mm in width. A binder was evenly sprayed over the obtained cut mat by using a spray so as to give 3.0% by weight of binder to the amount of alumina fibers of the cut needle treating mat.

Then, by drying the cut mat to which the binder was allowed to adhere for 5 minutes at 140° C., a shortest mat was manufactured.

A mat located outside the shortest mat (hereinafter, also referred to as an outermost mat) was further manufactured by following the same procedure, except that the full length was set to 1100 mm. Both of the obtained two mats have a weight per square meter of 1160 g/m$^2$ and a mat thickness of 6.5 mm.

The two mats thus manufactured were laminated so that the positions that equally divide the full length of each of the mats into two are exactly overlapped with each other.

Figure 8A:
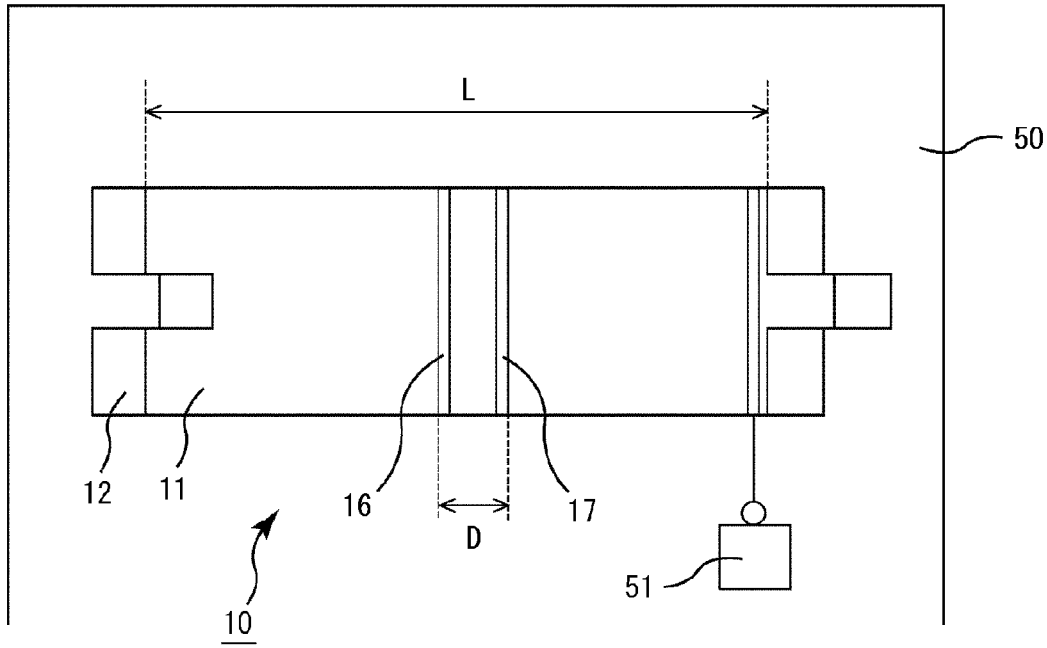
FIG. 8A and FIG. 8B are explanatory views schematically illustrating the procedure of a displacement test.
Figure 8B:
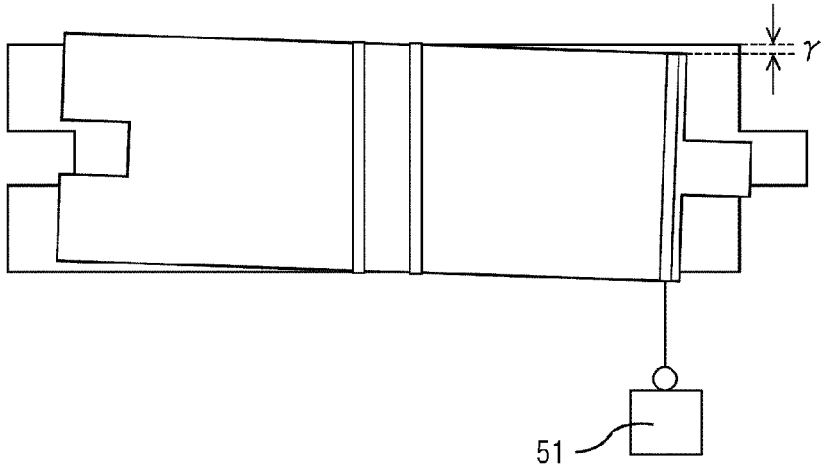

Subsequently, as illustrated in FIG. 8A, the fixed portions 16 and 17 are symmetrically formed at two positions across the position that equally divides the full length of each of the mats into two by a 15 mm wide tape, and thereby the laminated mats 11 and 12 were fixed to each other. In a projection view of each of the fixed portions to the side face having the longitudinal direction of the mat, the maximum projection distance (interval indicated by a double-pointed arrow D in FIG. 8A) between fixed portions was set to one twentieth of the full length of the shortest mat. Since the full length of the shortest mat was 1054 mm, the maximum projection distance D was 52.7 mm. In the present example, since two fixed portions are formed, the projection distance between two fixed portions is the maximum projection distance. As illustrated in FIG. 8A, with this maximum projection distance, two fixed portions were formed to manufacture the holding sealing material 10. FIG. 8A and FIG. 8B are explanatory views schematically illustrating the procedure of a displacement test.

Examples 2 to 8

Holding sealing materials were manufactured in the same manner as in Example 1, except that the ratio of the maximum projection distance to the full length of the shortest mat in each example was set to the value shown in Table 1.

Comparative Example 1

A holding sealing material was manufactured in the same manner as in Example 1, except that, as a holding sealing material according to Comparative Example 1, a fixed portion was formed at one position that equally divides the full length of the shortest mat into two.

A displacement test and a winding property test were conducted on each of the holding sealing materials manufactured in Examples 1 to 8 and Comparative Example 1. Here, since the displacement between each of the mats presumably seem to become larger as the maximum projection distance becomes smaller, the displacement test was performed on the samples of Examples 1 to 3, and 8 having smaller maximum projection distances in the samples of Examples 1 to 8 and on the sample of Comparative Example 1. Since the gap between the end portions, and the like upon winding seem to become larger, the winding property test was performed on the samples of Examples 3 to 7 having larger maximum projection distances in the samples of Examples 1 to 8.

(Displacement Test)

The displacement test was carried out as follows: as illustrated in FIG. 8A, the outermost mat 12 out of the two mats was first fixed to the wall 50 over the full length after the width direction of the holding sealing material 10 was set to the vertical direction. Subsequently, a weight 51 (250 g; 2.5 N) was hung at one end portion of the shortest mat 11, and at this moment, the distance (mm) (interval indicated by γ in FIG. 8B) between one end portion of the outermost mat 12 and the end portion of the shortest mat 11 on the same side as the side of the one end portion was measured as a displacement amount and the degree of displacement was evaluated.

(Winding Property Test)

The appearance of the holding sealing material after winding the manufactured holding sealing material around the exhaust gas treating body having a diameter of 13 inches was observed. In the appearance of the holding sealing material at this time, the winding property was evaluated on the basis of the gap (mm) generated between both ends of the holding sealing material.

Table 1 shows the results.

TABLE 1

| | Full length of shortest mat [mm] | Ratio of maximum projection distance to full length of shortest mat (maximum projection distance/ full length) | Projection distance [mm] | Dis-placement amount [mm] | Winding property test [mm] |
|---|---|---|---|---|---|
| Example 1 | 1054 | 1/20 | 52.7 | 2 | NA |
| Example 2 | 1054 | 1/3 | 351.3 | 2 | NA |
| Example 3 | 1054 | 1/2 | 527 | 1.5 | 0 |
| Example 4 | 1054 | 2/3 | 702.7 | NA | 2 |
| Example 5 | 1054 | 3/4 | 790.5 | NA | 2 |
| Example 6 | 1054 | 4/5 | 843.2 | NA | 6 |
| Example 7 | 1054 | 5/6 | 878.3 | NA | 9 |
| Example 8 | 1054 | 1/25 | 42.2 | 3 | NA |
| Comparative Example 1 | 1054 | NA | NA | 7.5 | NA |

NA = Not Available

In the holding sealing material manufactured in each of Examples 1 to 3, and 8, it was found that as the ratio of the projection distance between each of the fixed portions to the full length of the shortest mat becomes larger, the displacement amount decreases and each of the holding sealing materials presumably has a sufficient inhibitory effect to displacement between mats. On the other hand, in the holding sealing material of Comparative Example 1, since the displacement amount was considerably larger than those of Examples 1 to 3, and 8, presumably, displacement is more likely to be caused between each of the mats upon winding the holding sealing material around the exhaust gas treating body or transporting it.

It is surmised that the reason for a large displacement amount in Comparative Example 1 is because of generation of displacement of the mats with the fixed portion functioning as the fulcrum. That is, when the fixed portion is formed at one position, displacement tends to occur in the width direction of the mat around the fixed portion. The main reason is presumably that when both end portions of the holding sealing material are viewed from the fixed portion, these both end portions are free ends and tend not to regulate displacement in the width direction. In contrast, in the holding sealing material according to each of Examples 1 to 3, and 8, in the projection view of the fixed portions to the side face having the longitudinal direction of the mat, since at least one fixed portion different from the above-mentioned fixed portion is provided at different positions in the longitudinal direction, and since a fixed end portion exists on at least one end portion side when both end portions of the holding sealing material are viewed from each of the fixed portions, the degrees of freedom of displacement in the width direction tend to be greatly regulated. For these reasons, in the holding sealing material manufactured in each of Examples 1 to 3, and 8, it may be presumably easier to exert a sufficient inhibitory effect to displacement between mats.

In the holding sealing materials of Examples 3 to 7, there occurred no problem in the results of the winding property test, or occurred gaps so small as to be in a level satisfactory in product use. It may be easier to wind the holding sealing material of each of Examples 3 to 7 around the exhaust gas treating body with sufficient workability, and it is presumed that inconveniences such as gaps after winding tend not to occur. After winding the holding sealing material around the exhaust gas treating body, upon press-fitting holding sealing material into a casing, the holding sealing material is first compressed but then extends in a circumferential direction. Thus, such gaps will almost disappear.

Each of the holding sealing materials of Examples 6 to 8 can be used as a product without any difficulties. The displacement amount was a little large in Example 8, and a somewhat large gap occurred in the winding property test of Examples 6 and 7. This is presumably because in Example 8, each of the fixed portions came so closer to the center of the mat that the maximum projection distance became small, and the inhibitory effect to the displacement was slightly weakened. In Examples 6 and 7, it is presumably because a both-end fixed area existed so extensively that it may be less likely to absorb the difference between the outer peripheral length and inner peripheral length in the both-end fixed area upon winding. The above results show that it is possible to use the holding sealing material of Examples 6 to 8 sufficiently as a product; however, from the results of the displacement test, presumably, the desirable lower limit of the maximum projection distance D between the fixed portions is about one twentieth of the full length of the shortest mat, and from the results of the winding property test, the desirable upper limit of the maximum projection distance D is about three fourths of the full length of the shortest mat.

Second Embodiment

Next, the following will discuss a second embodiment, one embodiment of a holding sealing material and a method for manufacturing a holding sealing material according to the present invention.

Figure 9A:
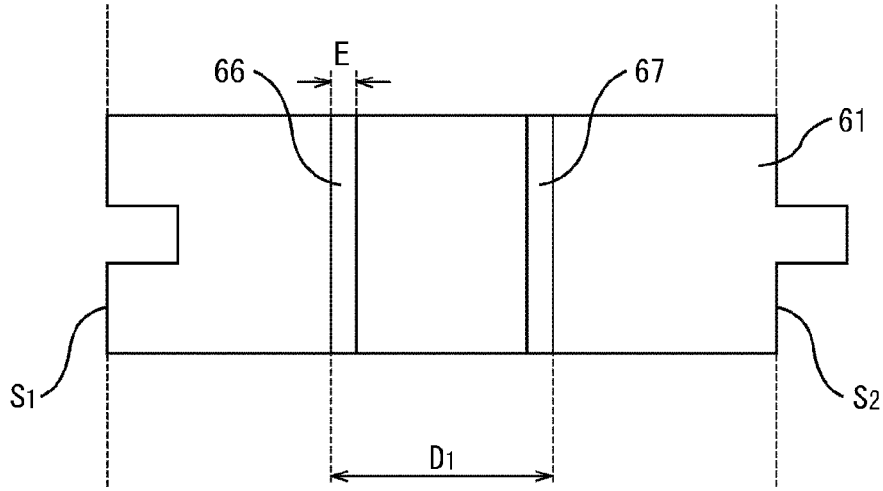
FIG. 9A and FIG. 9B are plan views each schematically illustrating the shortest mat that configures a holding sealing material of the second embodiment.
Figure 9B:
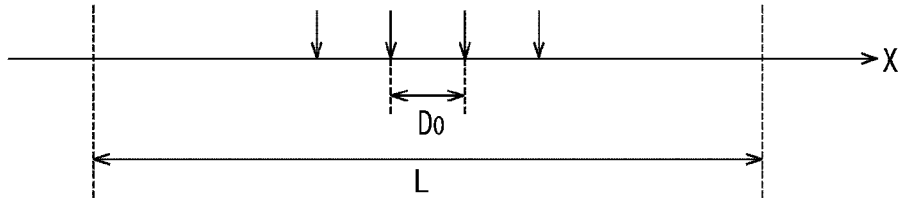

In the holding sealing material according to the second embodiment, a plurality of mats are fixed so as to have faces with a predetermined breadth on each of the fixed portions. The embodiment will be described with reference to FIG. 9A and FIG. 9B. FIG. 9A and FIG. 9B are plan view each schematically illustrating the shortest mat that configures a holding sealing material of the second embodiment.

As illustrated in FIG. 9A, in a shortest mat 61, for example, a fixed portion 66 and a fixed portion 67 are formed by an adhesive or the like. Here, the fixed portion 66 and the fixed portion 67 are formed over the entire width of the shortest mat 61, and in the longitudinal direction, each have a breadth indicated by a symbol E illustrated in FIG. 9A. In the holding sealing material illustrated in FIG. 9A, the fixed portion is formed over the entire width direction of the shortest mat 61, but it is, of course, not limited to this; the fixed portion may be spaced apart from the longer side face of the mat.

The fixed portion 66 is formed closer to the first shorter side $S_1$ of the shortest mat 61 while the fixed portion 67 is formed closer to the second shorter side $S_2$. Here, the maximum projection distance $D_1$ between the fixed portion 66 and the fixed portion 67 is defined as the distance between the end portion closer to the shorter side $S_1$ and the end portion closer to the shorter side $S_2$ of each of the fixed portions, as illustrated in FIGS. 9A and 9B.

Here, the breadth of the fixed portion 66 and that of the fixed portion 67 are not particularly limited to E. The percentage of breadth E to the maximum projection distance $D_1$ is preferably 0%<E< about 50%, more preferably 0%<E< about 40%, and still more preferably 0%<E< about 30%. The percentage can be changed based on the characteristics required of the holding sealing material.

As a method for forming a face fixation that specifies the fixed portion of the present embodiment, the face fixation may be formed by applying an adhesive between mats or may be formed by shifting machine-sewing little by little in the longitudinal direction.

Also in the holding sealing material of this second embodiment, the effects (1) to (3) and (6) to (13), which are the same effects as those in the first embodiment, can be obtained.

Third Embodiment

Figure 10A:
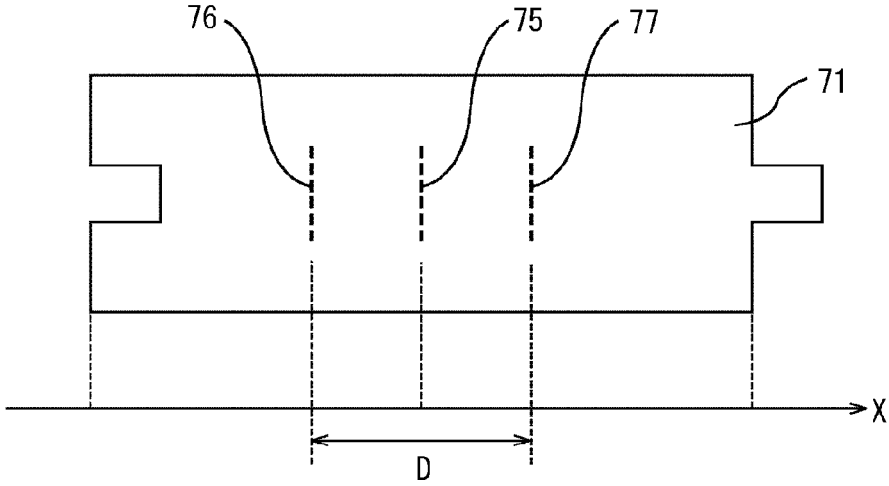
FIG. 10A is a plan view schematically illustrating another embodiment of a fixed portion.

The embodiment of the fixed portion is not limited to the first embodiment and the second embodiment, but three fixed portions may be formed. This embodiment will be described with reference to FIGS. 10A to 10C. FIG. 10A is a plan view schematically illustrating another embodiment of a fixed portion, FIG. 10B is a plan view schematically illustrating another embodiment of a fixed portion, and FIG. 10C is a plan view schematically illustrating another embodiment of a fixed portion.

On a shortest mat 71 illustrated in FIG. 10A, three fixed portions, i.e., a fixed portion 75, a fixed portion 76, and a fixed portion 77 are spaced apart from the longer side face without covering the entire width of the shortest mat 71. In this case, the maximum projection distance between the fixed portions is a projection distance between the fixed portion 76 and the fixed portion 77 indicated by D in FIG. 10A.

Figure 10B:
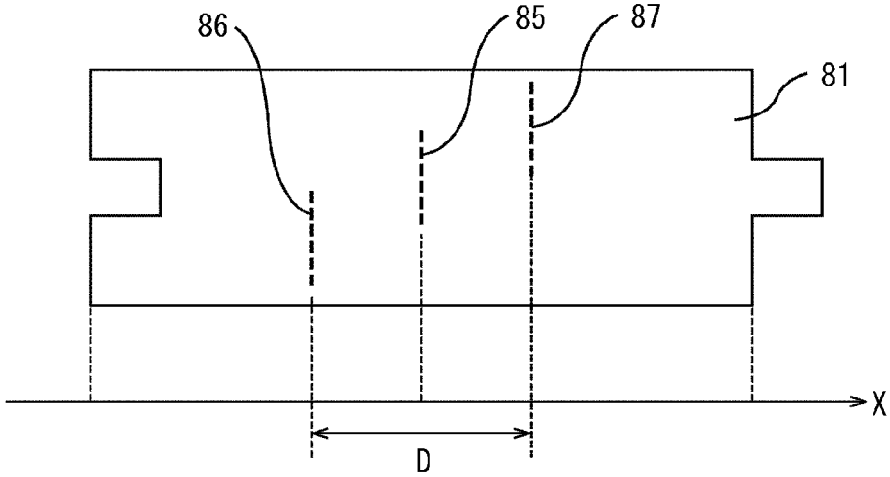
FIG. 10B is a plan view schematically illustrating another embodiment of a fixed portion.

As illustrated in FIG. 10B, a fixed portion 85, a fixed portion 86, and a fixed portion 87 are not aligned in the longitudinal direction of a shortest mat 81, and may be disposed so that each of the fixed portions are displaced in the width direction of the shortest mat 81. Even in this case, the maximum projection distance D upon projecting in the longitudinal axis X is a projection distance between the fixed portion 86 and the fixed portion 87.

Figure 10C:
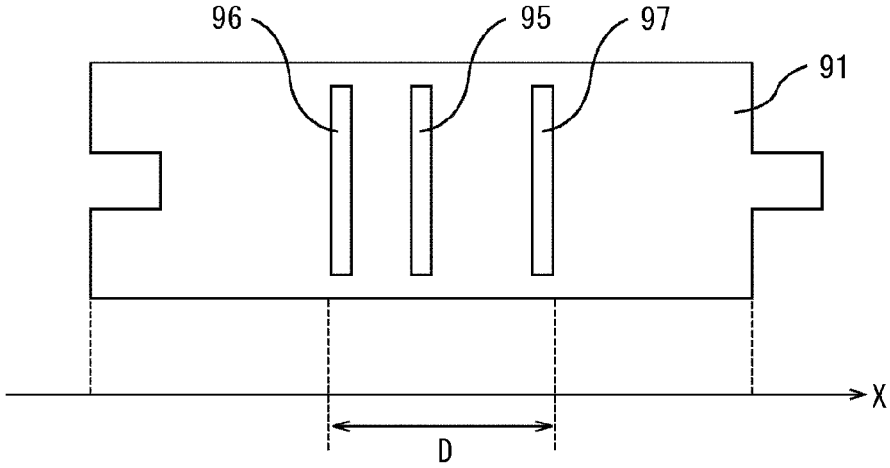
FIG. 10C is a plan view schematically illustrating another embodiment of a fixed portion.

As illustrated in FIG. 10C, a fixed portion 96 and a fixed portion 97 may be disposed so as to be asymmetric to a fixed portion 95. Even in this case, the maximum projection distance D upon projecting in the longitudinal axis X is a projection distance between the fixed portion 96 and the fixed portion 97.

Here, with respect to the fixed portions, not all the fixed portions need to be disposed at different positions in the longitudinal direction, as illustrated in FIGS. 10A to 10C; both of the fixed portions may be overlapped with each other upon being projected in a side view, and the two fixed portions and the other fixed portion may be disposed at different positions in the longitudinal direction upon projecting the three in a side view. For example, the fixed portion 75 and the fixed portion 76 illustrated in FIG. 10A may be disposed at different positions in the width direction and be overlapped with each other upon being projected in the longitudinal axis X, and these two fixed portion 75 and the fixed portion 76 may be disposed at a position different from that of the fixed portion 77 in the longitudinal direction upon being projected in a side view.

Other Embodiments

In the holding sealing material according to the embodiments of the present invention, the lower limit of the maximum projection distance in a side view between fixed portions is not particularly limited. A desirable lower limit is about one twenty-fifth of the length of the shortest mat in the longitudinal direction, a more desirable lower limit is about one twentieth of the length of the shortest mat in the longitudinal direction, a still more desirable lower limit is about one eighteenth of the length of the shortest mat in the longitudinal direction, a further desirable lower limit is about one sixteenth of the length of the shortest mat in the longitudinal direction, and an even more desirable lower limit is about one twelfth of the length of the shortest mat in the longitudinal direction. On the other hand, the upper limit of the maximum projection distance in a side view between fixed portions is also not particularly limited. A desirable upper limit is about five sixths of the length of the shortest mat in the longitudinal direction, a more desirable upper limit is about four fifths of the length of the shortest mat in the longitudinal direction, a still more desirable upper limit is about three fourths of the length of the shortest mat in the longitudinal direction, a further desirable upper limit is about two thirds of the length of the shortest mat in the longitudinal direction, an even more desirable upper limit is about one half of the length of the shortest mat in the longitudinal direction, and an even still more desirable upper limit is about one third of the length of the shortest mat in the longitudinal direction.

The method for fixing a plurality of mats is not limited to machine-sewing in the holding sealing material according to the embodiments of the present invention, and any fixing method can be employed as long as a plurality of mats can be fixed to each other by methods such as needling and fixing methods using an adhesive, a staple, a pin, a tape, and the like. Machine-sewing is desirable among these fixing methods. It is because it may be easier to firmly fix the mats to each other and also to respond to any change of specifications and the like.

In the case where machine-sewing is used as a method for fixing each of the mats in the holding sealing material according to the embodiments of the present invention, examples of the material of the sewing thread include: cellulosic fibers such as rayon, cuprammonium rayon, and acetate; synthetic fibers such as nylon, tetron, acryl, vinylon, operon, polyethylene, Teflon®, vinyl chloride, and vinylidene chloride; natural fibers such as cotton and silk; and the like.

In the holding sealing material according to the embodiments of the present invention, when machine-sewing is used as a method for fixing each of the mat materials, the stitching method is not limited to the above-mentioned lock stitching, and examples thereof include basting and the like.

Lock stitching is more preferable among these because it may be easier to fix each of the mat materials more firmly.

Upon performing machine-sewing in the holding sealing material according to the embodiments of the present invention, a method for twisting a sewing thread is not particularly limited, and a first twist may be performed in the first yarn stage, or a second twist may be performed after yarn doubling. Also, a Z twist (left-handed twist) or an S twist (right-handed twist) may be used; and in order to more easily prevent a twist back by rotation of a shuttle of the sewing machine, it is desirable to use a Z twist as a second twist.

The shapes of a recessed portion and a projected portion that are formed on a shorter side of the holding sealing material according to the embodiments of the present invention is not particularly limited as long as the shapes enable the recessed portion to be fitted to the projected portion. In the case where one set of a recessed portion and a projected portion is formed, desirably, the projected portion that projects over a size from about 10 mm in width×about 10 mm in length to about 300 mm in width×about 100 mm in length is formed on one portion of one shorter side, and the recessed portion that is fitted to the projected portion is formed on one portion of the other shorter side. In the case where an exhaust gas purifying apparatus is manufactured using the holding sealing material having such shapes of the recessed portion and the projected portion, an exhaust gas treating body tends to be surely held by the holding sealing material, leading to excellent handle ability.

In addition, a plurality of the recessed portions and projected portions that are fitted to each other may be formed in the shorter side of the holding sealing material, or recessed portions and projected portions may not be formed therein.

In the holding sealing material according to the embodiments of the present invention, the average fiber length of inorganic fibers is desirably from about 30 μm to about 120 mm, and more desirably from about 50 μm to about 100 mm.

In the holding sealing material according to the embodiment of the present invention, the average fiber diameter of inorganic fibers is desirably from about 2 μm to about 12 μm, and more desirably from about 3 μm to about 10 μm.

The amount of binder contained in the holding sealing material according to the embodiments of the present invention is desirably from about 0.2% by weight to about 20% by weight, more desirably from 0.5% by weight to about 15% by weight, and most desirably from about 1% by weight to about 12% by weight. In a case where the amount of the organic binder is about 0.2% by weight or more, since the bulk density of the holding sealing material tends not to be low, the pressfitability of the holding sealing material into the casing tends not to be lowered. Moreover, since the inorganic fibers that form the holding sealing material tend to be sufficiently bonded to one another, the inorganic fibers are less likely to be scattered. In contrast, in a case where the amount of the binder is about 20.0% by weight or less, since, upon use of an exhaust gas purifying apparatus, the amount of organic components in exhaust gases to be discharged tends not to increase, a higher load is less likely to be applied to the environment.

Although not particularly limited, the weight per square meter of the holding sealing according to the embodiments of the present invention is desirably from about 200 $g/m^2$ to about 2000 $g/m^2$, and more desirably from about 300 $g/m^2$ to about 1900 $g/m^2$. Although not particularly limited, the bulk density thereof is desirably from about 0.10 $g/m^2$ to about 0.30 $g/cm^3$.

The organic binder used for manufacturing the holding sealing material according to the embodiments of the present invention is not limited to the acrylic-based resin, and examples thereof include: rubbers such as acrylic rubber; water-soluble organic polymers such as carboxymethyl cellulose or polyvinyl alcohol; thermoplastic resins such as styrene resin; thermosetting resins such as epoxy resin; and the like. Particularly preferred among these are acrylic rubber, acrylonitrile-butadiene rubber, and styrene-butadiene rubber.

The emulsion may include a plurality of kinds of the above-mentioned organic binders.

In addition, examples of the emulsion include: a latex obtained by dispersing the above-mentioned organic binder in water; a solution in which the above-mentioned organic binder is dissolved in water or an organic solvent; and the like.

The thickness of each of the mats of the holding sealing material according to the embodiments of the present invention may be substantially the same as or different from each other. The thickness can be changed in consideration of flexibility, holding force, and the like which are required of the holding sealing material.

The inorganic binder used for manufacturing the holding sealing material according to the embodiments of the present invention is not limited to the above-mentioned alumina sol, and may be silica sol or the like.

Although not particularly limited as long as it is a heat-resistant metal, examples of the material for the casing forming one component of the exhaust gas purifying apparatus according to the embodiments of the present invention include metals, such as stainless steel, aluminum and iron.

In a case where an exhaust gas purifying apparatus may be manufactured by using a substantially cylindrical casing, what is called a sizing system may be used to manufacture the exhaust gas purifying apparatus. In the exhaust gas purifying apparatus, after an exhaust gas treating body, with a holding sealing material being wound around, has been inserted into a casing having an inner diameter larger than the total combined length of the diameter of the end face of the exhaust gas treating body and the thickness of the holding sealing material that has been wound around the exhaust gas treating body, the casing is compressed from the peripheral side by a pressing machine or the like.

The exhaust gas treating body forming one component of the exhaust gas purifying apparatus according to the embodiments of the present invention may be prepared as an integral exhaust gas treating body configured by one sintered body as a whole, illustrated in FIG. 4A, or may be prepared as an aggregated exhaust gas treating body obtained by using adhesive layers and combining a plurality of honeycomb fired bodies, each having a structure in which a large number of cells are longitudinally disposed in parallel with one another, with a cell wall being interposed therebetween.

Catalyst may be supported on the exhaust gas treating body forming one component according to the embodiments of the exhaust gas purifying apparatus of the present invention. Examples of the catalyst include: noble metals such as platinum, palladium, and rhodium; alkali metals such as potassium and sodium; alkali earth metals such as barium; metal oxides; and the like. These catalysts can be used alone or in combination of two or more.

In addition, the oxide catalyst is not particularly limited as long as it can lower the burning temperature of PM, and examples thereof include $CeO_2$, $ZrO_2$, $FeO_2$, $Fe_2O_3$, CuO, $CuO_2$, $Mn_2O_3$, MnO, complex oxides indicated by a composition formula $A_nB_{1-n}CO_3$ (in the formula, A is La, Nd, Sm, Eu, Gd or Y; B is an alkali metal or alkali-earth metal; C is Mn, Co, Fe or Ni; and $0 \leqq n \leqq 1$), and the like.

Each of these catalysts may be used alone, or two or more kinds of these may be used in combination; however, the catalyst desirably contains at least $CeO_2$.

By supporting a metal oxide of this kind, the burning temperature of PM tends to be lowered.

Examples of the method for applying catalyst to the exhaust gas treating body include: a method in which the exhaust gas treating body is impregnated with a solution containing catalyst and then heated; a method for forming a catalyst supporting layer consisting of an alumina film and applying catalyst to the alumina film; and the like.

Examples of the method for forming the alumina film include: a method in which the exhaust gas treating body is impregnated with a solution of a metal compound containing aluminum such as $Al(NO_3)_3$ and then heated; a method in which the gas treating body is impregnated with a solution containing alumina powder and then heated; and the like.

Examples of the method for applying catalyst to the alumina film include: a method in which the exhaust gas treating body is impregnated with a solution containing a noble metal, an alkaline metal, an alkaline earth metal, and a metal oxide, and the like, and then heated; and the like.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A holding sealing material comprising:

a plurality of mats having a longitudinal direction and comprising a lower mat and an upper mat laminated on the lower mat, each of said plurality of mats comprising inorganic fibers and having a substantially rectangular shape;

a length of the lower mat in the longitudinal direction being longer than a length of the upper mat in the longitudinal direction;

each of said plurality of mats being connected to each other at at least two fixed portions;

the at least two fixed portions being positioned at different positions in the longitudinal direction;

each of the at least two fixed portions being spaced apart from longer side faces of said plurality of mats;

wherein at least one of a first shortest distance and a second shortest distance is longer than a stitch length;

wherein the first shortest distance is a shortest distance between a first end portion of a fixed portion of the at least two fixed portions and a first longer side face of said plurality of mats, and the second shortest distance is a shortest distance between a second end portion of said fixed portion and a second longer side face of said plurality of mats;

wherein each of the at least two fixed portions is formed by machine-sewing using a sewing thread; and wherein reverse stitches are provided on at least one of a starting point and an end point of the machine-sewing.

2. The holding sealing material according to claim 1, wherein at least one distance among distances between the at least two fixed portions is from about one twentieth to about three fourths of a longitudinal length of a shortest mat having a shortest length in the longitudinal direction.

3. The holding sealing material according to claim 1, wherein each of the at least two fixed portions extends substantially along a width direction perpendicular to the longitudinal direction of said plurality of mats.

4. The holding sealing material according to claim 1, wherein each of the at least two fixed portions is positioned in a region within a range of about 50% to about 99.5% of a length in a width direction perpendicular to the longitudinal direction of said plurality of mats.

5. The holding sealing material according to claim 1, wherein each of said plurality of mats has a thickness of about 1.5 mm to about 15 mm.

6. The holding sealing material according to claim 1, wherein each of said plurality of mats has substantially same thickness.

7. The holding sealing material according to claim 1, wherein needling treatment is carried out on said plurality of mats in a width direction perpendicular to the longitudinal direction.

8. The holding sealing material according to claim 1, wherein the machine-sewing is carried out by lock stitching.

9. The holding sealing material according to claim 1, wherein the stitch length of the machine-sewing is from about 1 mm to about 100 mm.

10. The holding sealing material according to claim 1, wherein the sewing thread comprises at least one of cotton and polyester.

11. The holding sealing material according to claim 1, wherein the sewing thread has a diameter of about 0.1 mm to about 5 mm.

12. The holding sealing material according to claim 1, wherein the sewing thread has a color other than a transparent color and different from a color of each of said plurality of mats.

13. The holding sealing material according to claim 1, wherein a first twist is performed in a first yarn stage in the sewing thread.

14. The holding sealing material according to claim 13, wherein a second twist is performed in the sewing thread after yarn doubling.

15. The holding sealing material according to claim 14, wherein said second twist comprises a Z twist.

16. The holding sealing material according to claim 1, wherein the upper mat has first and second ends in the longitudinal direction, the lower mat has third and fourth ends in the longitudinal direction, and the first and second ends of the upper mat are positioned between the third and fourth ends of the lower mat.

17. The holding sealing material according to claim 1, wherein the upper mat has first and second ends in the longitudinal direction, the lower mat has third and fourth ends in the longitudinal direction, and either one of the first and second ends of the upper mat projects from either one of the third and fourth ends of the lower mat.

18. An exhaust gas purifying apparatus comprising:

an exhaust gas treating body comprising:

cell walls longitudinally extending to define cells;

a casing which accommodates said exhaust gas treating body; and a holding sealing material provided between said exhaust gas treating body and said casing to hold said exhaust gas treating body, said holding sealing material comprising:

a plurality of mats having a longitudinal direction and comprising a lower mat and an upper mat laminated on the lower mat, each of said plurality of mats comprising inorganic fibers and having a substantially rectangular shape;

a length of the lower mat in the longitudinal direction being longer than a length of the upper mat in the longitudinal direction;

each of said plurality of mats being connected to each other at least two fixed portions;

the at least two fixed portions being positioned at different positions in the longitudinal direction;

each of the at least two fixed portions being spaced apart from longer side faces of said plurality of mats;

wherein at least one of a first shortest distance and a second shortest distance is longer than a stitch length;

wherein the first shortest distance is a shortest distance between a first end portion of a fixed portion of the at least two fixed portions and a first longer side face of said plurality of mats, and the second shortest distance is a shortest distance between a second end portion of said fixed portion and a second longer side face of said plurality of mats;

wherein each of the at least two fixed portions is formed by machine-sewing using a sewing thread; and wherein reverse stitches are provided on at least one of a starting point and an end point of the machine-sewing.

19. The exhaust gas purifying apparatus according to claim 18, wherein at least one distance among distances between the at least two fixed portions is from about one twentieth to about three fourths of a longitudinal length of a shortest mat having a shortest length in the longitudinal direction.

20. The exhaust gas purifying apparatus according to claim 18, wherein each of the at least two fixed portions extends substantially along a width direction perpendicular to the longitudinal direction of said plurality of mats.

21. The exhaust gas purifying apparatus according to claim 18, wherein each of the at least two fixed portions is positioned in a region within a range of about 50% to about 99.5% of a length in a width direction perpendicular to the longitudinal direction of said plurality of mats.

22. The exhaust gas purifying apparatus according to claim 18, wherein each of said plurality of mats has a thickness of about 1.5 mm to about 15 mm.

23. The exhaust gas purifying apparatus according to claim 18, wherein each of said plurality of mats has substantially same thickness.

24. The exhaust gas purifying apparatus according to claim 18, wherein needling treatment is carried out on said plurality of mats in a width direction perpendicular to the longitudinal direction.

25. The exhaust gas purifying apparatus according to claim 18, wherein the machine-sewing is carried out by lock stitching.

26. The exhaust gas purifying apparatus according to claim 18, wherein the stitch length of the machine-sewing is from about 1 mm to about 100 mm.

27. The exhaust gas purifying apparatus according to claim 18, wherein the sewing thread comprises at least one of cotton and polyester.

28. The exhaust gas purifying apparatus according to claim 18, wherein the sewing thread has a diameter of about 0.1 mm to about 5 mm.

29. The exhaust gas purifying apparatus according to claim 18, wherein the sewing thread has a color other than a transparent color and different from a color of each of said plurality of mats.

30. The exhaust gas purifying apparatus according to claim 18, wherein a first twist is performed in a first yarn stage in the sewing thread.

31. The exhaust gas purifying apparatus according to claim 30, wherein a second twist is performed in the sewing thread after yarn doubling.

32. The exhaust gas purifying apparatus according to claim 31, wherein said second twist comprises a Z twist.

33. The exhaust gas purifying apparatus according to claim 18, wherein the upper mat has first and second ends in the longitudinal direction, the lower mat has third and fourth ends in the longitudinal direction, and the first and second ends of the upper mat are positioned between the third and fourth ends of the lower mat.

34. The exhaust gas purifying apparatus according to claim 18, wherein the upper mat has first and second ends in the longitudinal direction, the lower mat has third and fourth ends in the longitudinal direction, and either one of the first and second ends of the upper mat projects from either one of the third and fourth ends of the lower mat.

35. The holding sealing material according to claim 1, wherein both of the first shortest distance and the second shortest distance are longer than the stitch length.

36. The holding sealing material according to claim 1, wherein reverse stitches are provided on both of the starting point and the end point of the machine-sewing.

37. The exhaust gas purifying apparatus according to claim 18, wherein both of the first shortest distance and the second shortest distance are longer than the stitch length.

38. The exhaust gas purifying apparatus according to claim 18, wherein reverse stitches are provided on both of the starting point and the end point of the machine-sewing.

* * * * *

UNITED STATES PATENT AND TRADEMARK OFFICE

CERTIFICATE OF CORRECTION

PATENT NO. : 8,268,255 B2
APPLICATION NO. : 12/424737
DATED : September 18, 2012
INVENTOR(S) : Mitsunori Yoshimi, Masayuki Eguchi and Yasuhiro Tsuchimoto It is certified that error appears in the above-identified patent and that said Letters Patent is hereby corrected as shown below:

Column 27, Line 10, the line should read as follows:
at at least two fixed portions;

Signed and Sealed this
Fourth Day of December, 2012

David J. Kappos

David J. Kappos
*Director of the United States Patent and Trademark Office*